US011585086B2

(12) United States Patent
Lacas et al.

(10) Patent No.: US 11,585,086 B2
(45) Date of Patent: Feb. 21, 2023

(54) CONCRETE BLOCK SYSTEM, METHOD AND CONNECTOR

(71) Applicant: OLDCASTLE BUILDING PRODUCTS CANADA INC., Saint-John (CA)

(72) Inventors: Marc-André Lacas, Montréal (CA); Joël Rémillard, Terrebonne (CA); Bertin Castonguay, Montréal (CA); Robert Declos, Montréal (CA)

(73) Assignee: Oldcastle Building Products Canada Inc., Saint-John (CA)

( * ) Notice: Subject to any disclaimer, the term of this patent is extended or adjusted under 35 U.S.C. 154(b) by 40 days.

(21) Appl. No.: 16/637,126

(22) PCT Filed: Aug. 1, 2018

(86) PCT No.: PCT/CA2018/050935

§ 371 (c)(1),
(2) Date: Feb. 6, 2020

(87) PCT Pub. No.: WO2019/028548

PCT Pub. Date: Feb. 14, 2019

(65) Prior Publication Data

US 2020/0181902 A1 Jun. 11, 2020

Related U.S. Application Data

(60) Provisional application No. 62/542,997, filed on Aug. 9, 2017.

(51) Int. Cl.
*E04B 2/32* (2006.01)
*E04B 2/36* (2006.01)
(Continued)

(52) U.S. Cl.
CPC ..... *E04B 2/32* (2013.01); *E04B 2/34* (2013.01); *E04B 2/36* (2013.01); *E02D 29/0266* (2013.01); *E04B 2002/0252* (2013.01)

(58) Field of Classification Search
CPC ... E04C 1/395; E04B 2/36; E04B 2/08; E04B 2002/0252; E04B 2/12; E04B 2/94; E04B 2/32; E04B 2/34; E04B 2002/0247
(Continued)

(56) References Cited

U.S. PATENT DOCUMENTS 3,936,987 A * 2/1976 Calvin ..... E04B 2/08 52/309.1
4,597,236 A 7/1986 Braxton
(Continued)

FOREIGN PATENT DOCUMENTS

DE 2435139 A * 2/1975 ..... E04B 2/02
FR 1026321 A * 4/1953 ..... E04B 2/08
(Continued)

OTHER PUBLICATIONS

Translation of FR 1026321 (Year: 1953).*
(Continued)

*Primary Examiner* — Michael Safavi
(74) *Attorney, Agent, or Firm* — Merchant & Gould P.C.

(57) ABSTRACT

A concrete block system is provided and allows for the use of a single type of non-integral connector to perform different functions in a mortarless structure, the system comprising a plurality of structural concrete blocks and a plurality of veneer units. The same connector can be used to connect veneer units to structural blocks, to retain the veneer units in different orientations; to create near vertical installations or a setback between stacked rows of structural blocks. In addition, the system provides a single structural block, which can be used for both straight portions or corners of a same structure. The structural block can also be used to create double-sided walls, with opposite lateral walls being configured to received/retain veneer units thereon.

5 Claims, 25 Drawing Sheets

(51) Int. Cl.

| | |
|---|---|
| ***E04B 2/34*** | (2006.01) |
| *E02D 29/02* | (2006.01) |
| *E04B 2/02* | (2006.01) |

(58) Field of Classification Search
USPC ..... 52/270, 279, 586.2, 591.1, 591.3, 285.1, 52/285.3, 285.4, 269, 422, 513, 506.05
See application file for complete search history.

(56) References Cited

U.S. PATENT DOCUMENTS

| | | | | |
|---|---|---|---|---|
| 5,970,674 | A | 10/1999 | Guy | |
| 6,062,772 | A | 5/2000 | Perkins | |
| 7,410,328 | B2 | 8/2008 | Hamel | |
| 8,234,828 | B2 | 8/2012 | MacDonald | |
| 2011/0000161 | A1* | 1/2011 | Aube | E04B 2/46 52/563 |
| 2011/0072753 | A1 | 3/2011 | Macdonald | |
| 2016/0069078 | A1* | 3/2016 | MacDonald | E04C 2/38 52/506.05 |

FOREIGN PATENT DOCUMENTS

| | | | | |
|---|---|---|---|---|
| FR | 2506367 | A1 | 11/1982 | |
| GB | 2500331 | A * | 9/2013 | E02D 29/0266 |

OTHER PUBLICATIONS

Translation of DE 2435139 (Year: 1975).*
International Search Report and Written Opinion of the International Searching Authority for International Patent Application No. PCT/CA2018/050935 dated Oct. 29, 2018, 6 pages.

* cited by examiner

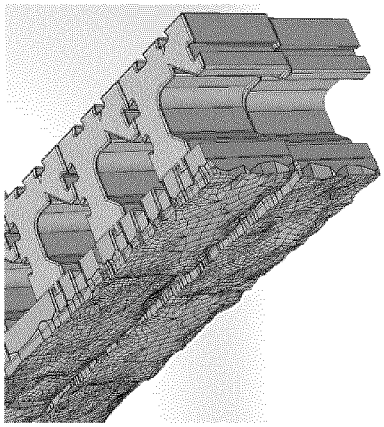
FIG. 6B
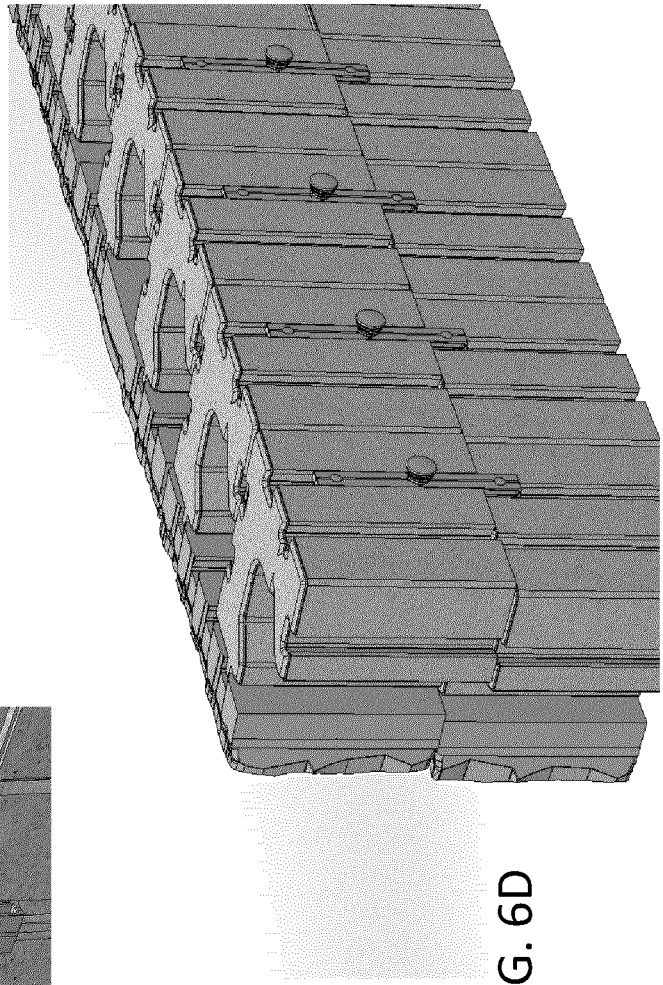
FIG. 6D
FIG. 6A
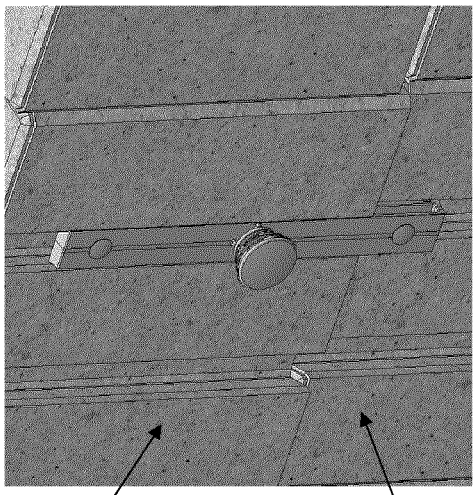

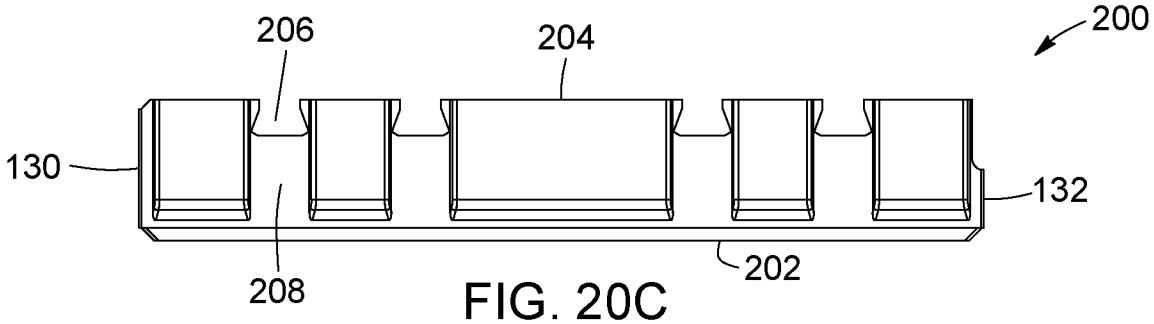
FIG. 20C
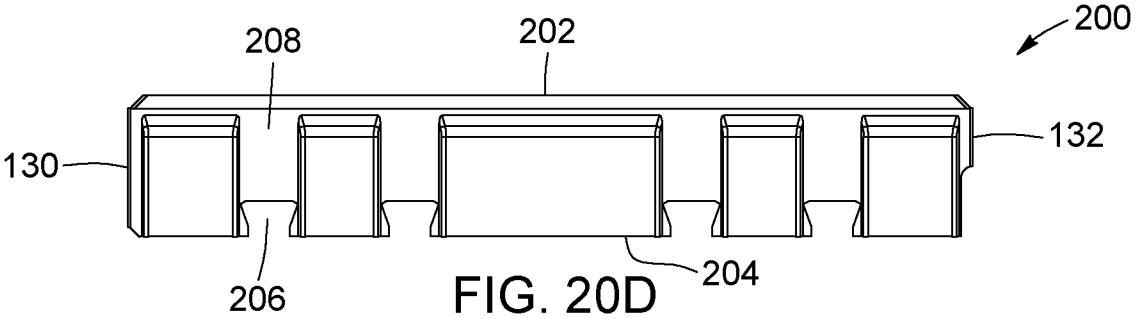
FIG. 20D
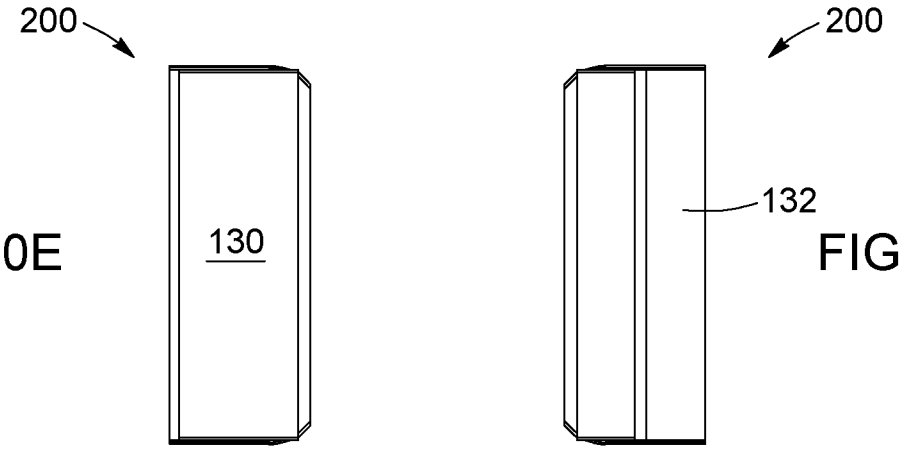
FIG. 20E
FIG. 20F

CONCRETE BLOCK SYSTEM, METHOD AND CONNECTOR

This application is a National Stage Application of PCT/CA2018/050935, filed 1 Aug. 2018, which claims benefit of U.S. Provisional Patent Application Serial No. 62/542,997, filed 9 Aug. 2017 and which applications are incorporated herein by reference. To the extent appropriate, a claim of priority is made to each of the above disclosed applications.

TECHNICAL FIELD

The present invention relates to concrete block systems and components, including structural blocks, veneer units and connectors, that may be used in walls, columns, steps and other types of structures.

BACKGROUND

Concrete blocks and units that are used in wall constructs, including retaining walls, columns; or in other types of constructs, such as steps, are sometimes provided with different stone appearances over exposed portions thereof.

There exist different wall systems that allow for relatively easy and flexible methods of erecting such walls. Existing systems require different types of main/structural blocks, and different types of face/veneer blocks and connectors. An example of such system is described in U.S. Pat. No. 7,410,328.

It is therefore desirable to provide a concrete block system and related components, in particular those which may be used in walls, columns, steps and other types of structures.

SUMMARY

According to one aspect of the invention, a concrete block system for constructing a structure is provided, the structure being preferably a mortarless structure. The system comprises a plurality of structural blocks made of concrete, a plurality of veneer units, and a plurality of connectors. The connectors are distinct and non-integral to the structural blocks and veneer units. Each structural block has a top side, a bottom side, and lateral sides. At least two of the lateral sides are provided with block channels. Each veneer unit comprises an exposed face and a rear face, the rear face being provided with veneer channels. The connectors are each is sized, shaped and configured to attach the veneer units to the structural blocks. Advantageously, any given connector from said plurality of connectors is usable for attaching a veneer unit to a structural block. The connectors can also be used to connect structural blocks together. Preferably, the connector allows for creating a preset setback between two stacked structural blocks, or for near-vertical installations. Preferably, one side of the connector allows for creating the setback between two stacked blocks, and the other side of the connector allows for creating a small gap or spacing between two stacked blocks, for a near vertical structure. Two different size of spacing are possible between rows of stacked blocks, depending on which side of the connector is inserted in the block channels.

According to possible embodiments, the veneer units can also be installed on the structural blocks via male portions protruding on at least one of the lateral sides of the structural blocks, said male portions being shaped and sized to be inserted in a veneer channel of the veneer unit. The male portions of the structural blocks can be shaped as ribs extending along the height of the blocks. The structure made from the concrete block system can be, for example, a retaining wall, a double-sided wall, a stair, a column, etc.

Still preferably, the connectors allow for installing the veneer units on the structural blocks at different angles, i.e. the veneer units can be installed vertically or horizontally relative to the ground, and can also be installed at angles, for example, at 30 or 60 degree-angles.

According to another aspect, each structural block has a top face and a bottom face. Preferably, the top face and bottom face are substantially L-shaped. The structural block includes four lateral faces and a concave inner face extending between top and bottom faces. Two of the lateral faces are wide lateral faces forming a corner in said block, and two of the lateral faces are short lateral faces. The concave inner face is located between the short lateral faces and forms a cavity or recess in the structural block. The inner face can be formed one or several sidewalls. Two of the lateral faces are provided with connecting elements, which are formed and shaped in the structural block.

As for the veneer units, each of the veneer units has an exposed face and a rear face. Preferably, the veneer unit includes two short lateral faces and two long lateral sides. The rear face of the veneer unit is provided with connecting elements, which are preferably veneer channels, extending along the height or length of the units, or at angle, depending on the embodiment.

Each connector is sized, shaped and configured to attach the veneer units to the structural blocks. The connector can optionally attach two structural blocks together, via the respective block and veneer connecting elements, wherein any given connector from said plurality of connectors is suitable for connecting two structural blocks together, or for connecting a veneer unit to a structural block.

According to another aspect, the invention is directed to the connector for use in the concrete block system. The connector comprises two opposed faces, with at least one face being provided with a knob. According to one embodiment, the connector has an elongated body having opposite first and second ends, a first face extending between said first and second ends; and a second face, opposite the first face. The second face is provided with at least one shoulder, for creating the setback between two stacked structural blocks. A knob is located on the first face of the connector. The body and the knob are each sized, shaped and configured to be insertable in a channel of one of the veneer units or one of the structural blocks, for connecting the veneer units to the structural blocks. According to another embodiment, the connector comprises knobs on both the first and second faces, with a base plate centered between the knobs.

According to yet another aspect, a method of constructing a structure with the concrete block system described above is provided. The method includes the steps of placing at least two structural blocks side by side and connecting one of the veneer units to one of the structural blocks, by inserting the body or knob of another connector into a block channel of one of said first and second blocks, and by inserting the knob or body of the same connector in the veneer channel of the veneer unit.

Optionally, the method can include the steps of stacking at least one block over one of the first and second structural blocks, which as disposed side by side; inserting the knob of another connector in the block channel of the stacked block and rotating the connector around the knob to lock the connector in place, a spacer disposed on the body of the connector spacing away or separating the two blocks by the thickness of the spacer, i.e. the structural block underneath the stacked block is separated by a preset distance.

Optionally, the method may also include the steps of stacking at least one structural block over one of the first and second side by side structural blocks; and inserting the body of another connector in the block channel of the stacked block, with the knob of the connector projecting outwardly from the block channel, a shoulder of the connector resting over the structural block underneath the stacked block, creating a setback between the stacked block and the two adjacent blocks below.

Still optionally, the method can include the steps of inserting the knob of another connector in the block channel of one the first and second blocks; with the body of the connector extending at angle relative to the block channel of said one structural block; positioning one of the veneer units relative to the structural block with the block channel of the structural unit at said angle relative to the veneer channel of the veneer unit; and retaining the veneer unit to the structural block, by fitting an end of the connector in the veneer channel of the veneer unit.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which:

FIG. 6A is a closed-up view of a connector inserted in a channel of a structural block. FIG. 6B is a top perspective view of a veneer unit connected to structural blocks, with the male portions of the structural blocks inserted in the channels of the veneer unit. FIG. 6D is a rear perspective view of a structure erected with components of the block system, with connectors inserted in channels of the structural blocks to create a setback between the lower and upper rows of structural blocks.

FIGS. 20A to 20F are respective top, bottom and side views of structural block of FIG. 20.

DETAILED DESCRIPTION

In the following description, similar features in different embodiments have been given similar reference numbers. For the sake of simplicity and clarity, namely so as to not unduly burden the figures with unneeded references numbers, not all figures contain references to all the components and features; references to some components and features may be found in only one figure, and components and features of the present disclosure which are illustrated in other figures can be easily inferred therefrom.

Figure 1B:
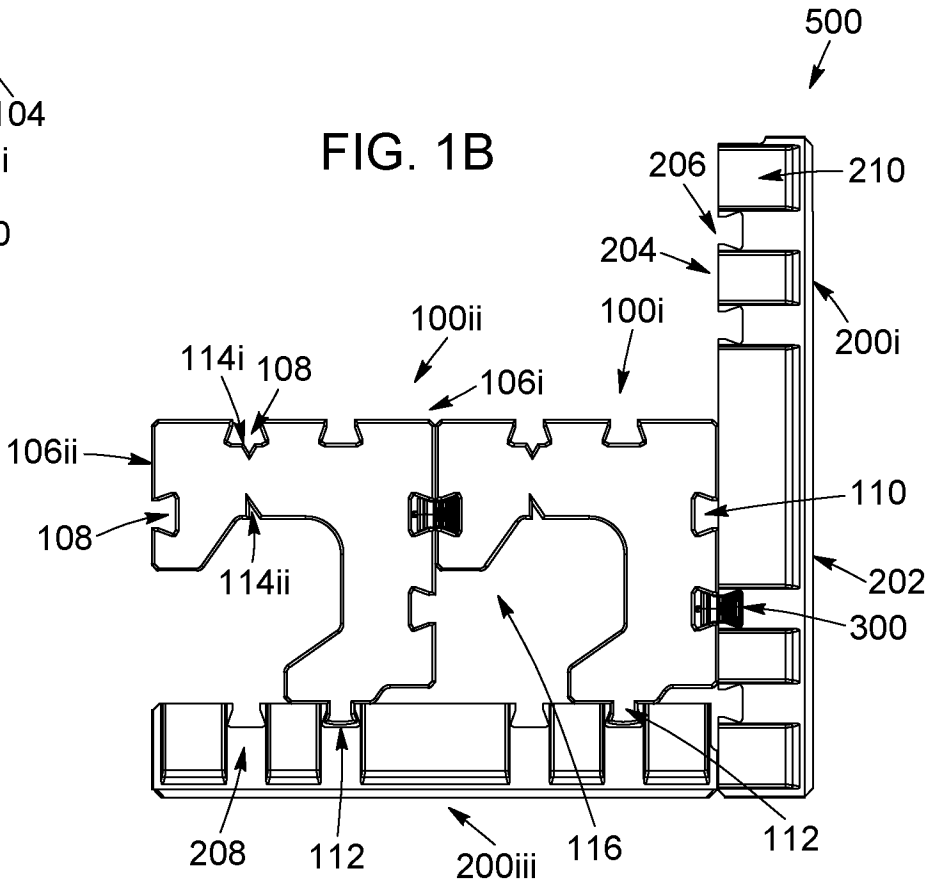
FIG. 1B is a top view of the structure of FIG. 1A.
Figure 1A:
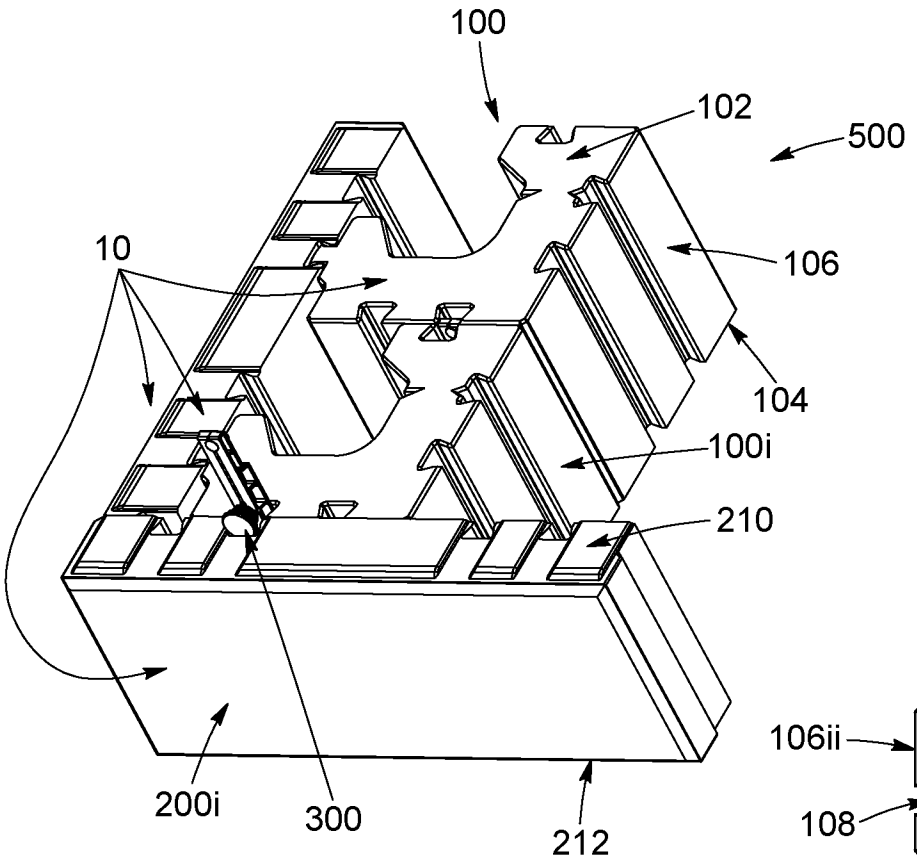
FIG. 1A is a top perspective view of a portion of a structure constructed with components of the block system, according to a possible embodiment.

With reference to FIGS. 1A and 1B, a portion of a structure 500 is shown, created with some components of the block system 10 of the invention. The structure can be any type of concrete construct, including for example a retaining wall, a double-sided wall, steps of a stair or a column. Preferably, the structure and concrete system are mortarless, i.e. they do not require the use of mortar to provide structural integrity to the structure. In FIG. 1B, two structural blocks 100*i*, 100*ii*, are placed side by side. The structural blocks are made of concrete or of a concrete-based composition. Two veneer units, 200*i*, 200*ii*, are connected or retained to the structural blocks 100. The veneer units are also made of a concrete-based composition. The veneer units are placed orthogonally one relative to the other, thereby forming the corner of the structure 500. In this example, a connector 300, connects the veneer unit 200*i* to the structural block 100*i*. The structural blocks can also be arranged in stacked rows, to create walls, columns or other erected structures, as will best shown in the following Figures.

The structural blocks 100 are preferably identical in shape, to facilitate the construction of the structure. The concrete system 10 of the invention provides a single structural block type 100 that can be used to create a structural portion of a concrete structure.

FIGS. 19, 19A-19F show different views of the structural block 100, used in the partial structure illustrated in FIGS. 1A and 1B, according to a possible embodiment. Each structural block 100 has a top side 102, a bottom side 104, and lateral sides 106 extending between the top and bottom sides 102, 104. In this embodiment, the blocks have a shape reminiscent of an L, but other shapes are possible. In this embodiment, a top face 122 and a bottom face 124 are substantially L-shaped. The block includes four lateral faces 126, 128, 130, 132 and a concave inner face 134, extending between top face 122 and the bottom face 124. The lateral faces 126, 128 are wider, and referred to as wide, full or main lateral faces. They intersect at the outer corner of the structural blocks and they extend over the entire width of the block. They form the "legs" of the L-shaped block 100. The lateral faces 130, 132 are shorter lateral faces, and referred to as short lateral faces. They form the end or extremity of the legs of the L-shaped block. The shorter or end lateral faces preferably have a width about half the width of the wider lateral sides. The concave inner face 134 is located between the short lateral faces 130, 132. The inner face 134 forms a cavity or recess in the structural block. The inner face 134 also forms the inner corner of the L-shaped block. The inner face 134 can be formed by one or several sidewalls of sub-faces. At least two of the lateral faces are provided with connecting elements formed and shaped in the block. The connecting elements can include female and male elements, such as protuberances or channels and grooves. In the illustrated embodiment, the connecting elements include block channels 108, which are preferably dovetail-shaped, and ribs 112. In this example, the wide lateral faces 126, 128 are each provided with two channels 108. One short lateral face 130 is provided with a block channel 108, and the other short lateral face 132 is provided with a male portion or rib 112. The rib 112 extends vertically along one of the lateral side of the structural blocks 100, and is sized, shaped and configured to be insertable in a veneer channel 206 of a veneer unit 200, which has essentially the same shape and size as the block channels. The structural blocks 100 are also shaped with a cavity or recess 116, that can be used to receive gravel therein. The inner face 134 forms the recess 116. Thanks to its shape, the position of the block channels 108 and of the rib 112, the same structural block 100 can be used for different functions in the structure, for instance to form corners, starting blocks, double-sided walls, single-sided walls, etc. Optionally, the structural blocks may include notches 114*i* to facilitate breaking off a portion of the block. Preferably, a notch is provided on the rear wall of one of the block channels, toward the end of one of the "legs" of the block, and another notch 114*ii* is provided on an inner side of the block, the two notches 114*i*, 114*ii* facing each other.

A veneer unit similar to the ones illustrated in FIGS. 1A and 1B is shown more clearly in FIGS. 20, and 20A-20F. The veneer unit 200 comprise an exposed face 202, and a rear face 204. In this embodiment, the veneer unit is substantially rectangular, with two long lateral faces 226, 228 and two short lateral faces 130, 132. At least one dimension of the veneer unit is preferably a multiple of the height of the structural block. In this example, the height of the longer side of the veneer unit is the same as the height of the structural block. Still preferably, the width of the longer side of the veneer unit is twice the width of the full or wide lateral sides of the structural unit. This provides modularity to the block system, allowing to position the veneer units in different orientations relative to the structural blocks.

The rear face 204 faces and connects to the lateral faces of the structural blocks 100. The rear face 204 of the veneer units 200 is provided with one or more connecting elements 240. In this embodiment, the connecting elements 240 are veneer channels 206, preferably extending between the lateral faces 226, 228, along the entire height of the unit. The veneer unit is preferably also made of concrete, but other materials are possible.

Figure 7:
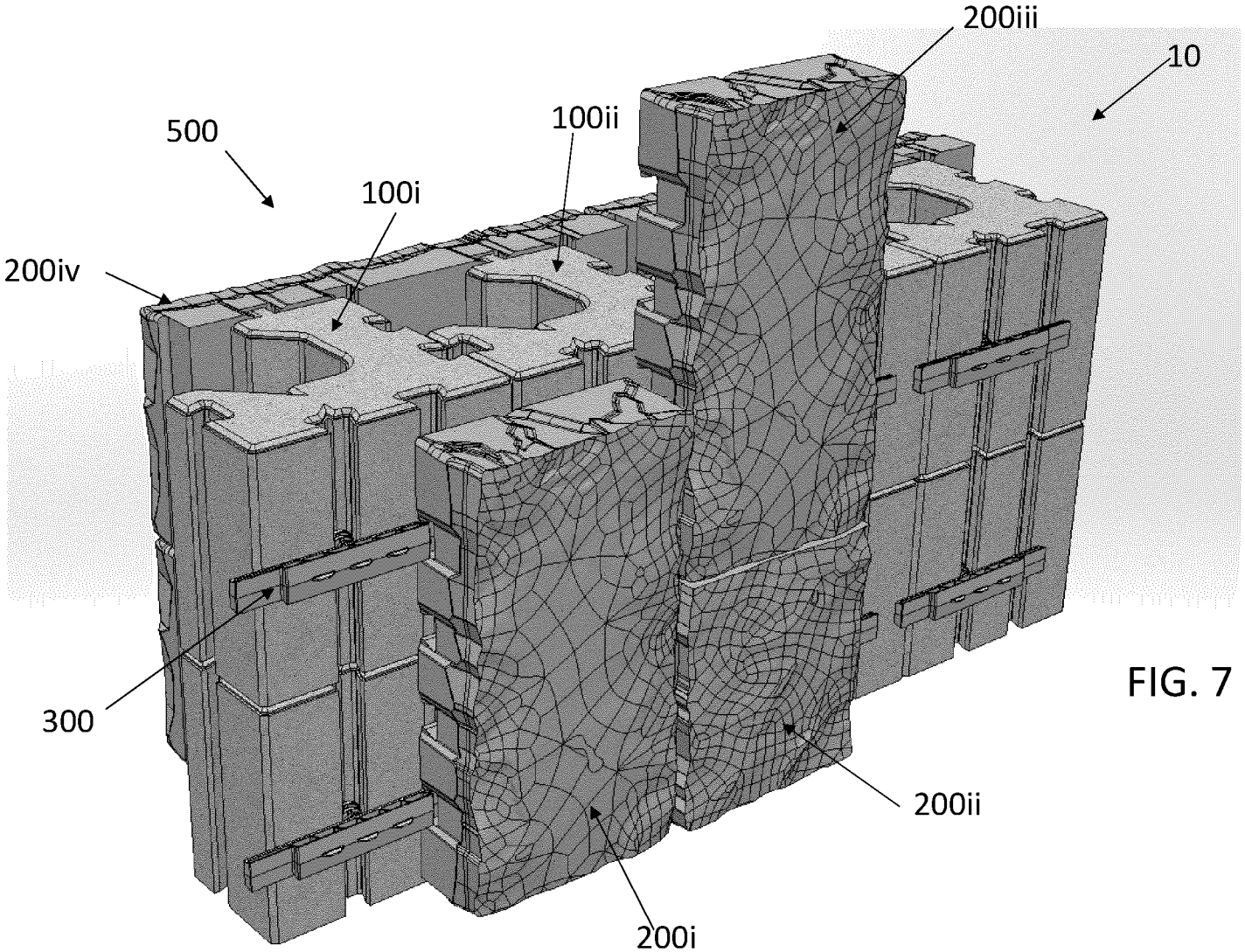
FIG. 7 is a top perspective view of a portion of a structure constructed with components of the block system, according to another possible embodiment.
Figure 15:
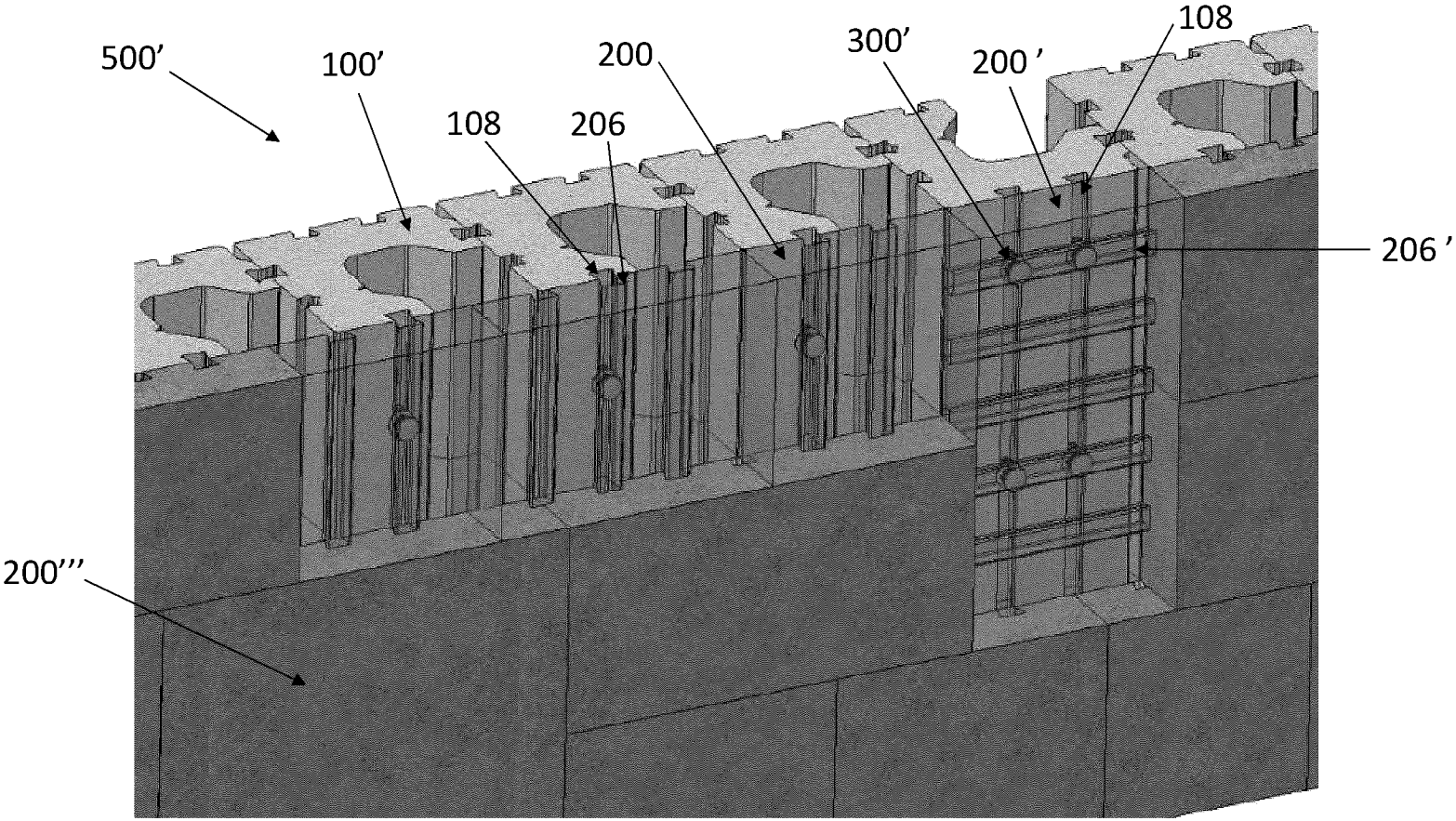
FIGS. 15, 16A and 16B are enlarged views of portions of the structure of FIG. 14, with some of the veneer units shown in transparency.

In the present embodiment, the veneer units are shaped as rectangular prisms, but other shapes can be considered. The veneer units 200 may optionally be provided with grooves 208 along their top and bottoms faces 210, 212, The grooves 208 are preferably aligned with the veneer channel and allows connecting the veneer unit in a "shiner" configuration, with the longer side extending horizontally, or in "sailor" configuration, with the longer side extending vertically. While the veneer units are shown with their channels in the same orientation as (i.e. parallel to) the block channels, it is possible to install the veneer units orthogonally relative to the structural blocks, as shown in FIG. 7 or 15, or even at different angles. The veneer units can also be shaped to form tiles of a tessellation. The channels and grooves of the veneer units may even be positioned at obliquely, i.e. at angle on the rear face 204 of the veneer units, to form a tessellation when connected to the structural blocks 100.

The veneer channels and the block channels preferably have the same shape, so that the connectors 300 may be used to connect to structural blocks 100 with veneer units 200. Preferably, the block channels 108 and/or the veneer channels 206 have a dovetail shape 110 with a narrower portion opening on the lateral sides.

Before explaining the different possible configurations and arrangements of the structural blocks 100 and veneer units 200 relative to the one another, the connectors 300 will be described in more detail.

Referring to FIG. 9A to 11C, a possible embodiment of a connector 300 for use in the concrete block system 10 described above is provided. The connector has an elongated body 302 having a first end 304 and a second end 306. The connector is preferably substantially rectangular in shape, so as to fit in the block or veneer channels of the structural blocks and veneer units. The connector has a first face or first side 308 and a second face or side 310, opposite the first face 308. The faces 308, 310 extend between the first and second ends 304, 306. A knob 312 is provided on the first face 308, said first face 308 also being referred to as the "knob" face. The second face 310 is provided with at least one shoulder 316, and preferably two, for creating a setback between two stacked structural blocks, as will be apparent when describing FIGS. 6A to 6D later in the description. The shoulders 316*i*, 316*ii* define a raised portion or "setback" portion 324, which protrudes from the second face 310. In a preferred embodiment, the setback or height of the raised portion, is between 5 and 15 mm, and preferably 8 mm, but other dimensions are possible. In the present case, the raised portion 324 is centrally located on the connector, but if it is more practical, it does not need to be centered. It this embodiment, the raised portion is also rectangular, but other shapes are possible. The main requirement is that the raised portion comprise a shoulder or rim that can be "seated" on the edge of the top side of a structural block 100. The body 302 and the knob 312 of the connector are each sized, shaped and configured to be insertable in either the channel 108 or 206 of a structural block 100 or a veneer unit 200, to connect the veneer units to the structural blocks or adjacent structural blocks together.

Optionally, the connector 300 incudes at least one spacer 314 provided on the first face 308, for creating a vertical spacing between two stacked structural blocks, allowing for a near vertical installation of the blocks, as will be described in relation to FIGS. 4 and 5A-5C. In this particular embodiment, the connector 300 includes two spacers 314*i*, 314*ii*, which are shaped as protuberances projecting from the first face 308. More specifically, the spacers have a circular dome shape, but different configurations are possible. For example, the spacers could be shaped as small pads positioned on the narrower ends of the connector.

Figure 5B:
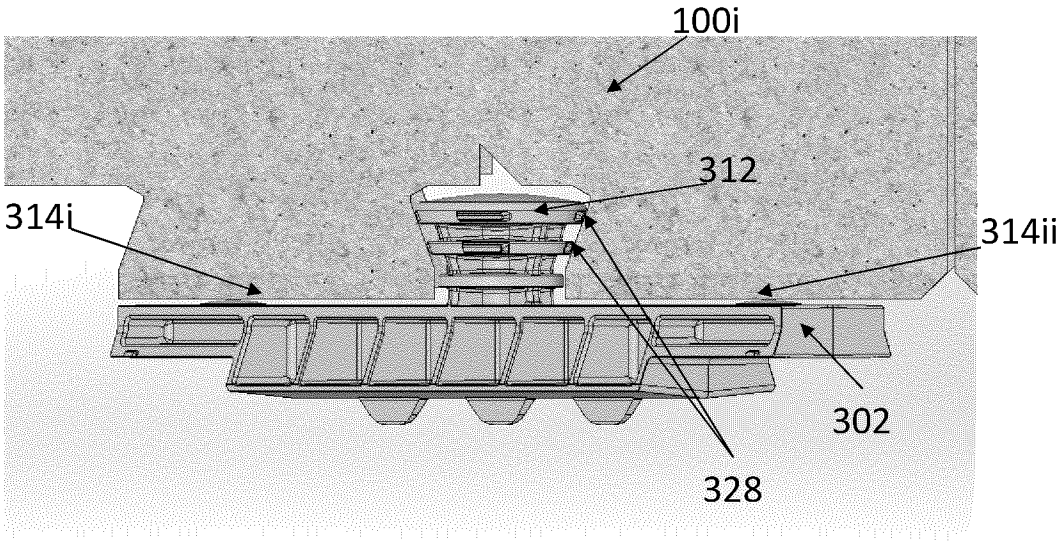
FIG. 5B is a top view, in close-up, of the connector of FIG. 5A, showing the knob inserted and blocked in the channel of one of the structural blocks.
Figure 5A:
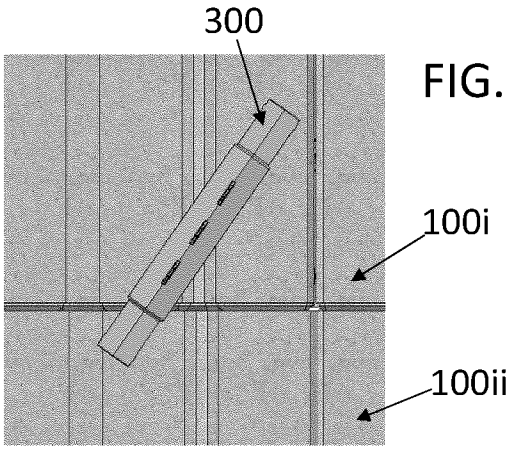
FIG. 5A is close-up view of one of the connector of the structure of FIG. 4.
Figure 11C:
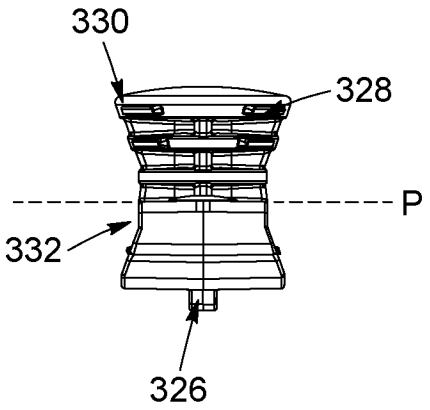
FIG. 11C is an view of the end portion of the connector of FIGS. 9A and 9B.
Figure 11A:
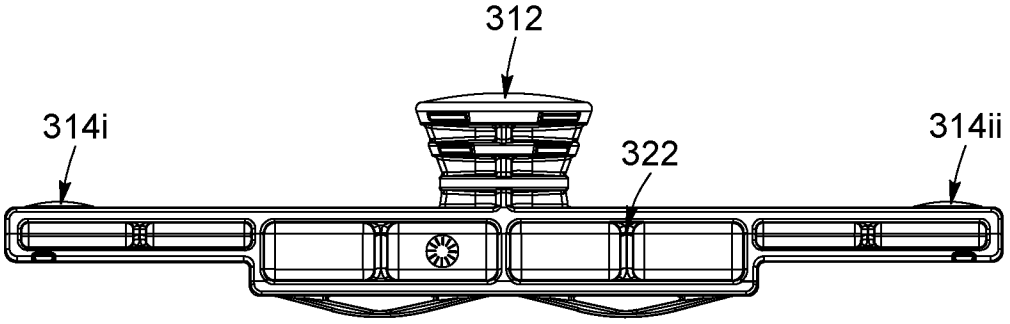
FIGS. 11A and 11B are side views of the connector of FIGS. 9A and 9B.
Figure 11B:
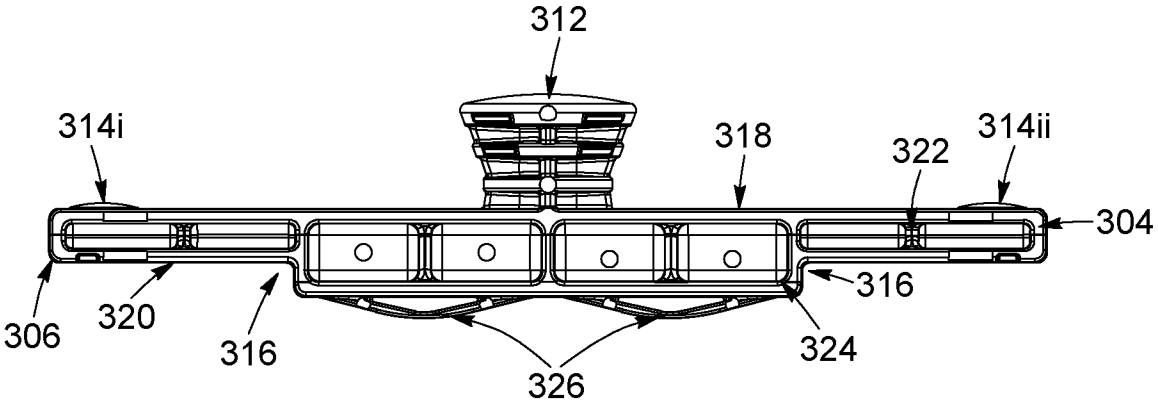

As best shown in FIGS. 11A-11C, the knob 312 of the connector preferably has a frustroconical shape, with the base portion 332 narrower than the head portion 330. The knob on the connector not only allows installers to more easily grab and manipulate the connector, but also ensures that the knob fits tightly in the veneer or block channels, with its profile, when viewed from the side, substantially matching the dove-tail profile of the channels. As best shown in FIG. 11C, the profile of the connector 300 is substantially symmetrical relative to the plane P. The knob may also include friction elements 328, in this case shaped as fins, to frictionally engage with the sidewalls of the channels, when the connector is rotated about the knob. As can be appreciated, the fins are located on the lateral sides of the knob such that they will not prevent or block the knob from sliding within a channel, but will stop the rotation of the knob when the connector is turned about the knob (as shown in FIG. 5B), since by turning the knob, the fins will become in contact with the sidewall of the channel. The friction element 328 can block the rotation of the connector when the knob is inserted in a channel of a structural block, and the connector is rotated about the knob's central axis. In this embodiment, the knob comprises ribs forming the sides of the knob, but other configurations are possible. Instead of friction fins, it can also be considered to have the lateral sides of the knob larger along one direction relative to another, the uneven width the knob 312 thereby also allowing to block rotation of the knob within a channel.

Still referring to FIGS. 11A-11C, the connector 300 may be provided with at least one friction element 326. In the present case, the connector 300 comprises two friction elements 326, defined as arc-shaped ribs. These elements provide resiliency to the connector when the body of said connector is inserted in a channel, the friction elements 326 pressing against the backwall of the channel. Instead of the arc-shaped ribs, fins could also be used. The connector 300 may be solid or not. In the embodiment of FIGS. 11A-11C, the connector comprises first and second outer walls 318, 320 spaced apart by partitions 322. The connector 300 is preferably made of plastic, such as polyethylene, but other materials are possible.

Figure 2:
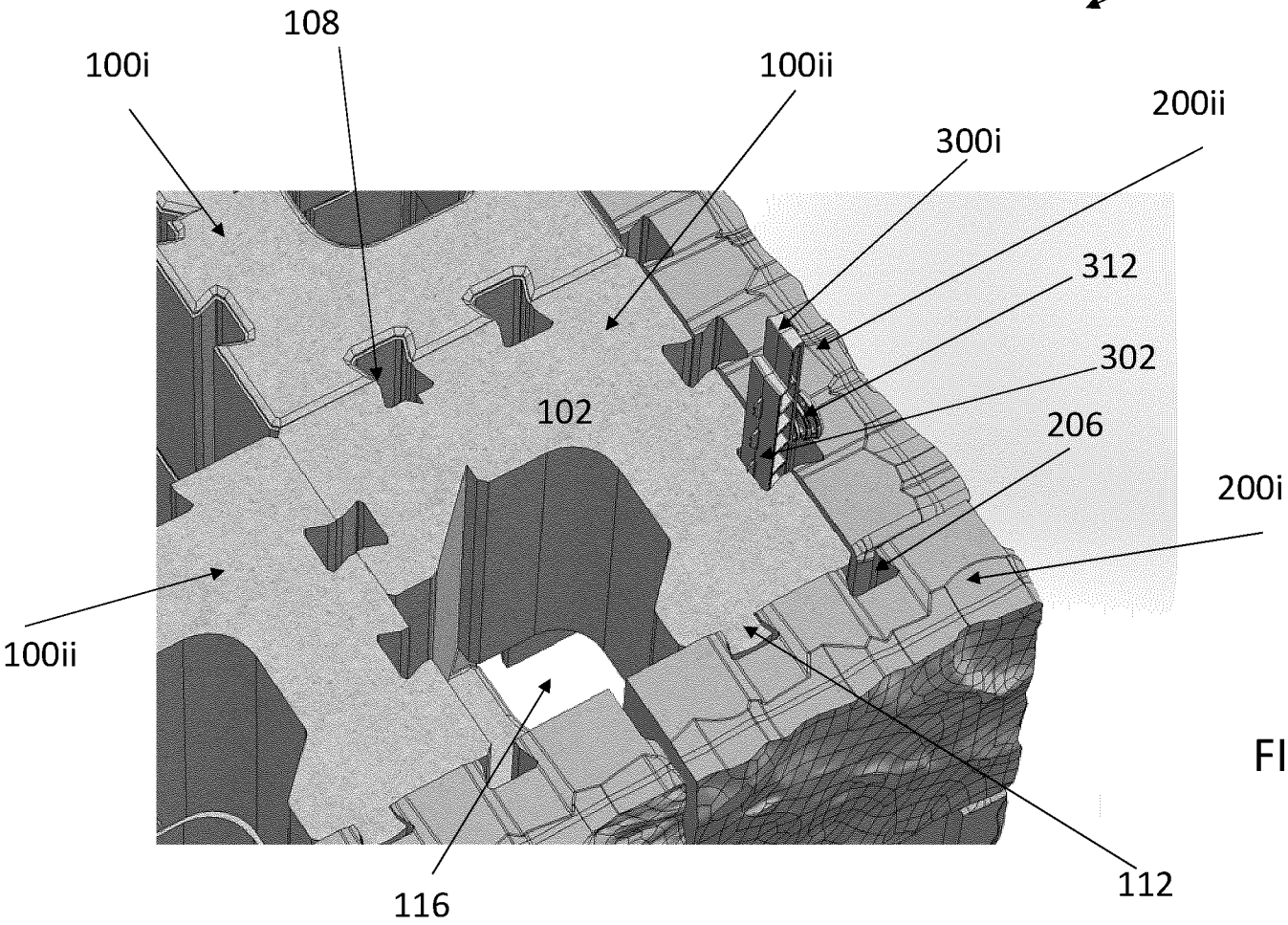
FIG. 2 is a close-up view of the corner of the structure shown in FIG. 1.
Figure 3:
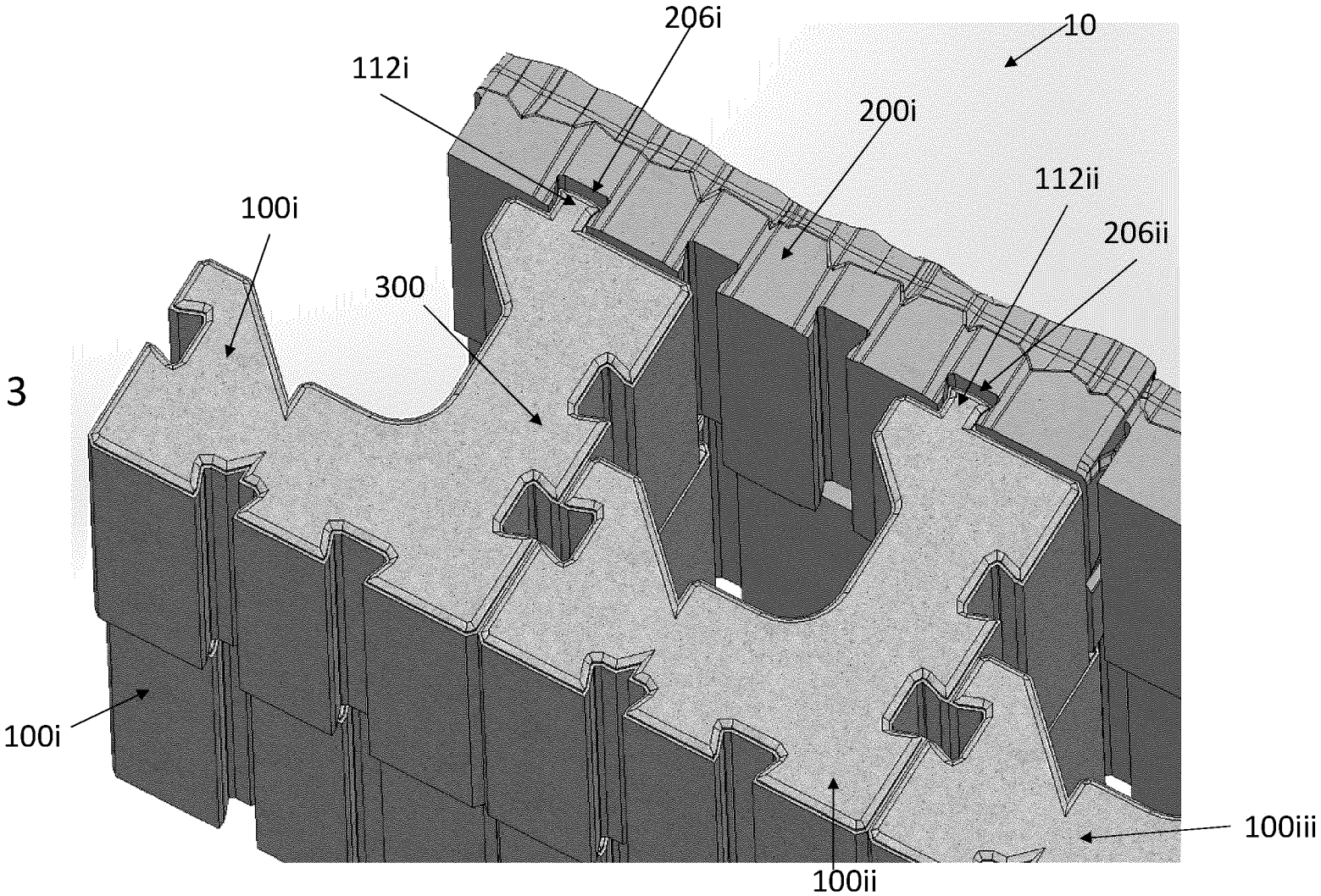
FIG. 3 is a close-up view of an end portion of a structure.
Figure 4:
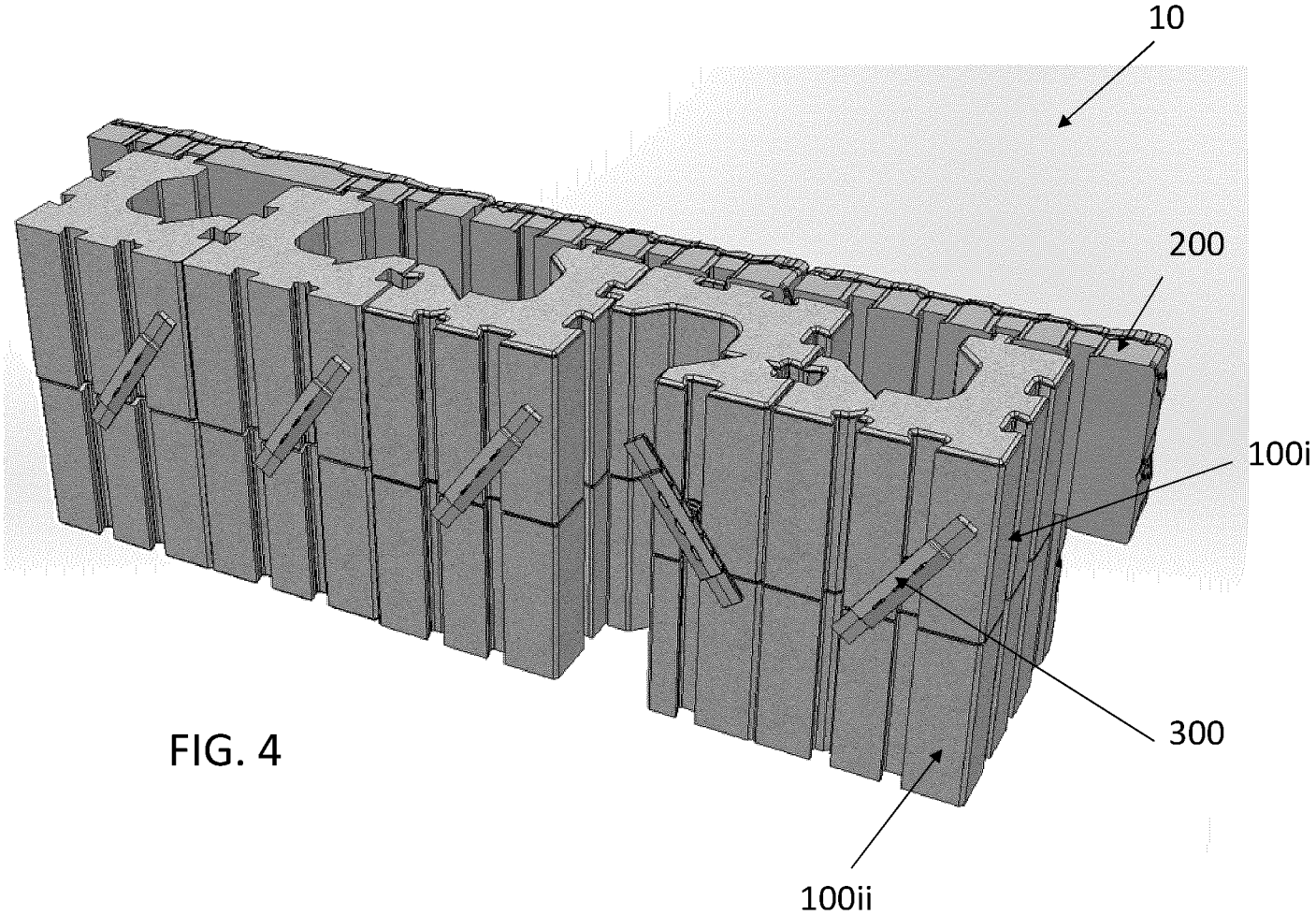
FIG. 4 is a rear perspective view of a portion of a structure, constructed with components of the block system, according to a possible embodiment.

Referring to FIG. 2, a connector 300*i* is used to connect the veneer unit 200*ii* to the structural block 100*ii*. The knob 312 is inserted in the veneer channel of veneer unit 200*ii*, and the body of the connector 300*i* is inserted in the block channel of the structural block 100*ii*. Of course, the other way around is possible, with the knob of connector 300*i* inserted in the structural block 100*ii* and its body inserted in the veneer unit 200*ii*. It is possible to connect or retain the veneer units to structural blocks via the rib 112 protruding from one side of the structural blocks, such as shown for veneer unit 200*i* connected to the structural blocks 100*ii* and 100*iii*. However, the concrete system 10 as proposed, allows for the use of a single type of structural blocks for both straight and corner portions of the complete structures, using also a single type of connectors, and also optionally, a single type of veneer units. The cavity 116 formed by the recess of the structural block 100*ii* and the rear face of veneer unit 200*i* can be filled with gravel, to provide increase structural strength to the wall. FIG. 3 shows yet another possible configuration of a structure built with the concrete system 10 of the invention, with the veneer unit 200*i* connected to the structural blocks 100*i*, 100*ii* by insertion of the ribs 112*i*, 112*ii* into corresponding veneer channels 206*i*, 206*ii*.

While the embodiments of the structural blocks presented previously include dovetail male portions 112, it can be considered to omit them completely, such that the structural blocks be only provided with block channels 108 shaped and configured to accommodate the connectors 300. For example, in FIG. 1B, the two ribs 112 on blocks 100*i*, 100*ii* can be replaced by block channels 108. In this case, both outer sides of the blocks 110*i*, 110*ii* can be connected to the veneer units 200 using connectors 300. An example embodiment of such a structural block will be explained in more detail in reference to FIG. 13. In addition, it yet other embodiments of the invention, it will be noted that dovetail connectors that allow connecting the structural blocks together can be either male or female dovetail connectors. Other shapes than a dovetail shape can also be used. In addition, the structural blocks do not necessarily need to be connected in a structure, and thus connectors between structural blocks are optional. For structures where the structural blocks need to be connected, the connection can be achieved with complementary dovetail connectors formed in the blocks. For example, in FIG. 1B, instead of using connector 300*ii* to connector blocks 100*i*, 100*ii*, one of the blocks 100*i*, 100*ii* can include a male dovetail or rib, that connects into corresponding female dovetail/channel of the other block. In other words, the structural blocks can be provided with complementary connecting portions, such as dovetails, male or female, positioned such as to allow connection of the blocks together.

Figure 5C:
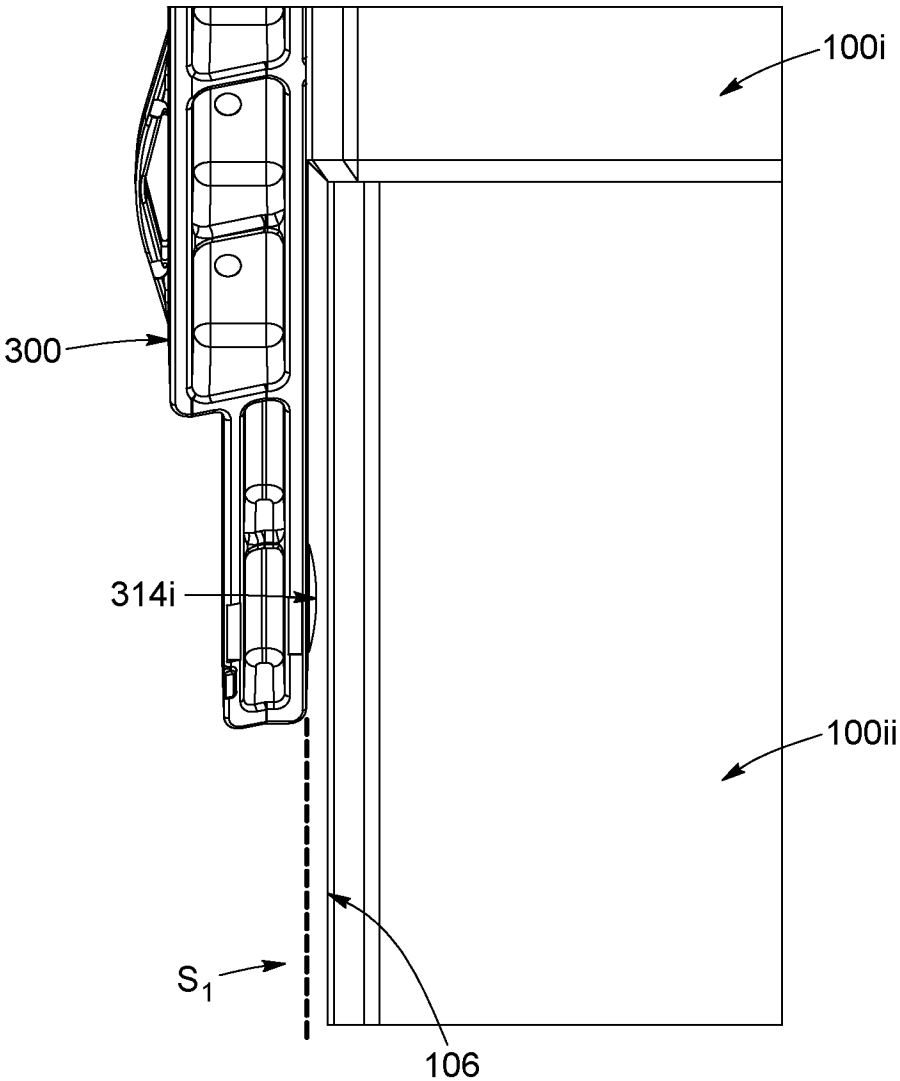
FIG. 5C is a side view, in close-up, of the connector of FIGS. 5A and 5B, showing how a space is created between two stacked structural blocks, for a near vertical installation.
Figure 6C:
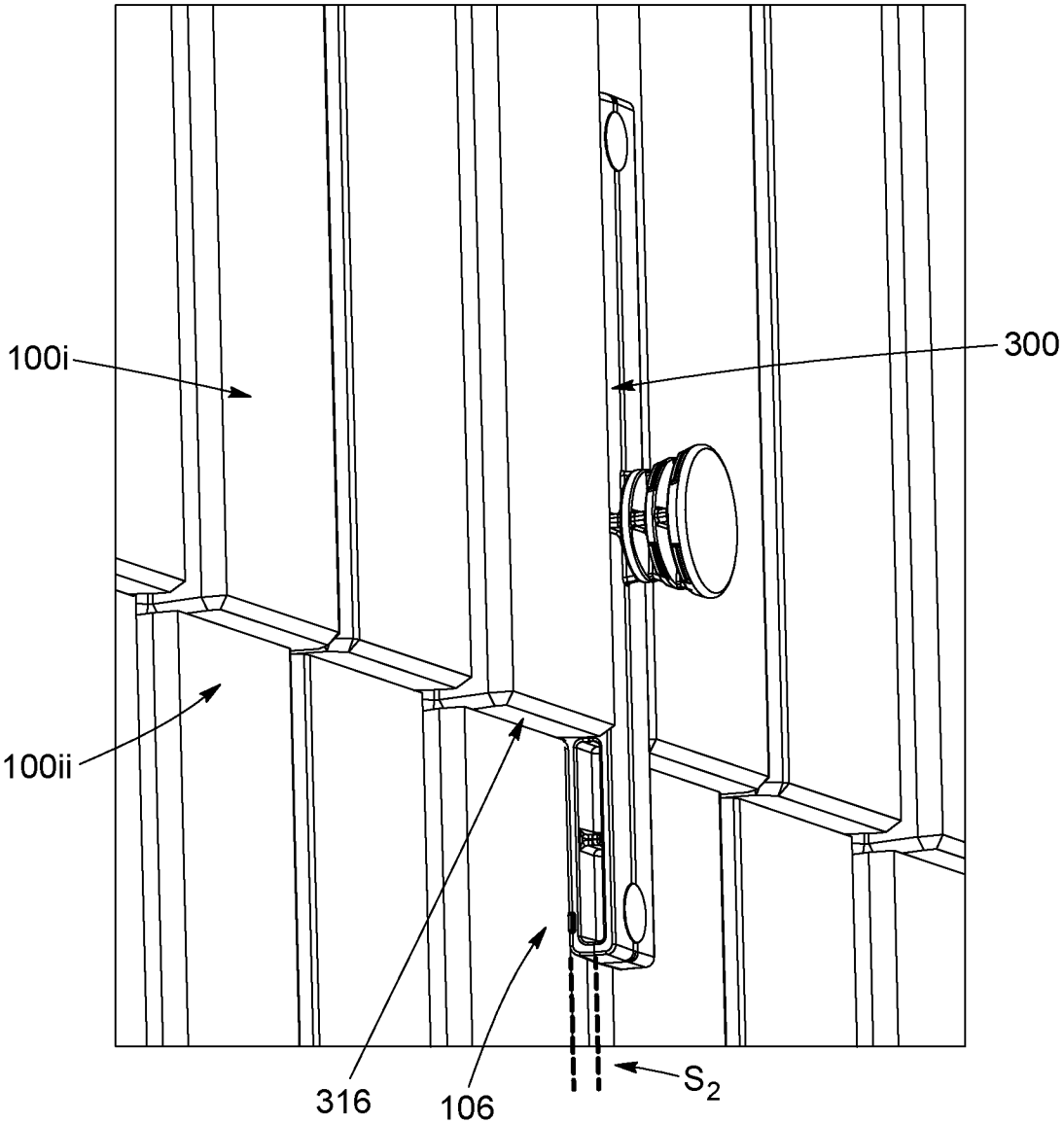
FIG. 6C is a side perspective view of the connector of FIG. 6A.

Referring now to FIGS. 4 and 5A-5C, yet a third possible function of the connector 300 consists of using it to create a small spacing $S_1$, as identified in FIG. 5C, between two stacked blocks 100*i* and 100*ii*. This advantageously allows erecting near vertical installations. Over time, soil maintained against a vertical structure pushes against the structure and can move it slightly. By erecting a structure with a slight set back, the effect of the soil pushing against the structure can be compensated by the slight setback angle, which will prevent the structure to lean frontward over time. By inserting the knob of the connector 300 in a block channel of the upper structural block 100*i*, and turning the connector about its knob 312, the fins 328 will eventually lock the connector in place, at an angle which can vary, for example, between 30 and 60 degrees, and preferably between 35 and 45 degrees, depending on the position of the fins on the lateral sides of the knob. Once locked in place, the connector is no longer aligned with the channels of block 100*ii* below. The spacers 314*i* rest against the lateral side 106 of the lower structural block 100*ii*, thus spacing away block 100*i* relative to block 100*ii*, by the spacing S, along an horizontal direction, insuring a positive batter of the erected wall/structure. In other words, as a result of using the connectors and placing them at an angle relative to the channels, the blocks 100*i*, 100*ii* will be stacked or mounted on one another with a slight vertical angle, which is called in the field a "near vertical installation".

Referring now to FIGS. 6A-6D, a fourth possible function of the connector 300 will be described. In this case, the connector 300 has its body inserted in a block channel of a structural block, with its knob protruding outwardly from the channel. The connector 300 is slid down to the bottom of the channel of the upper block 100*i*, the raised portion 324 of the connector abutting against the top face of the block 100*ii* below, and the narrower end of the connector 300 resting against the lateral face 106 of structural block 100*ii*. This configuration of the connector and blocks creates a setback or spacing $S_2$, required when erecting sustaining walls, for example. As can be appreciated, the width of the raised portion and of the narrower ends or legs of the connector are chosen based on the size of the setback needed.

Figure 8A:
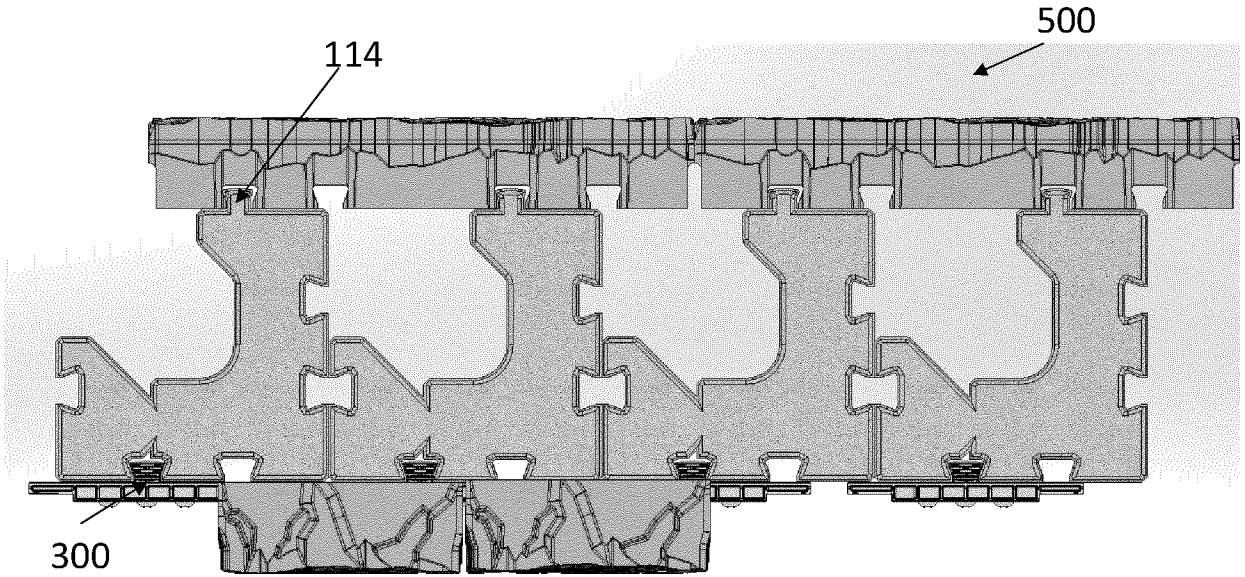
FIG. 8A is a top view of the portion of the structure shown in FIG. 7.
Figure 8B:
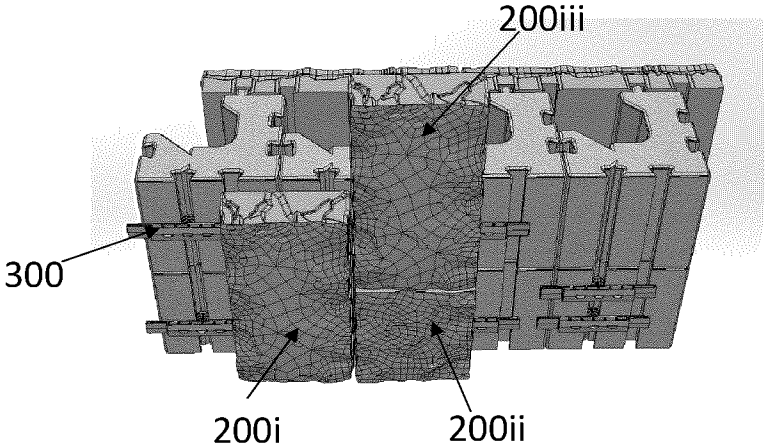
FIG. 8B is another top perspective view of the portion of the structure shown in FIG. 7.
Figure 9B:
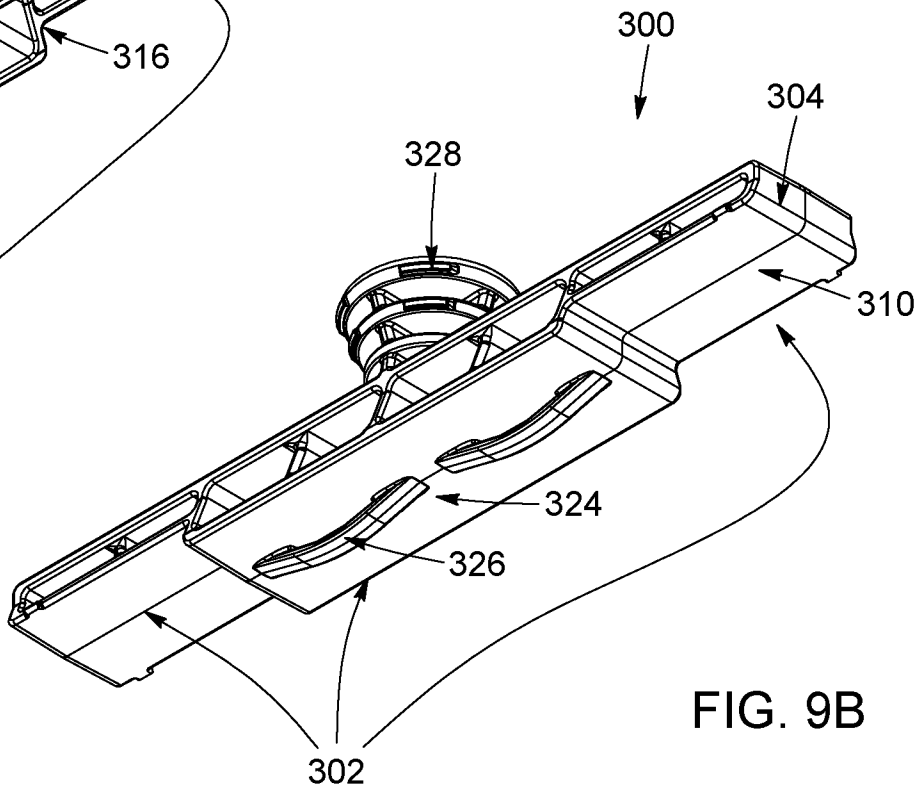
FIGS. 9A and 9B are different perspective views of a connector, according to a possible embodiment.
Figure 9A:
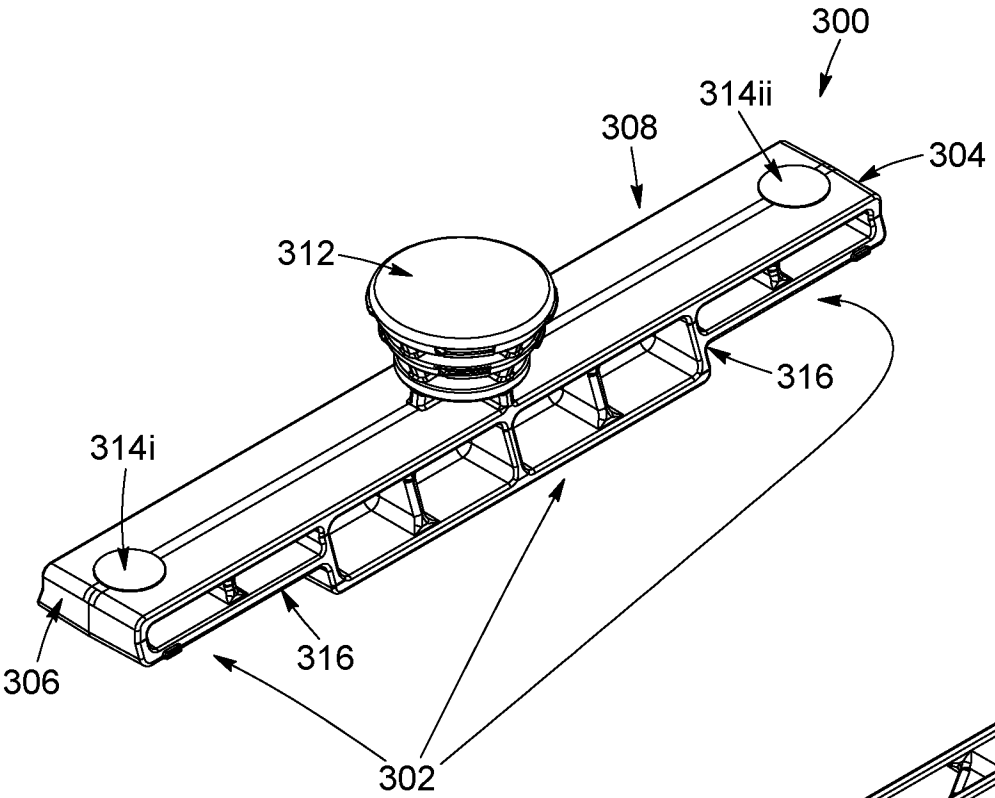
Figure 10A:
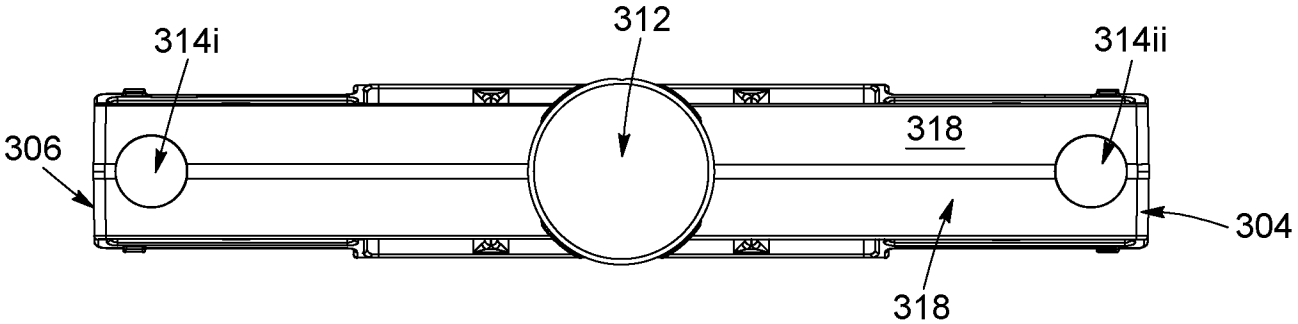
FIGS. 10A and 10B are top and bottom views of the connector of FIGS. 9A and 9B.
Figure 10B:
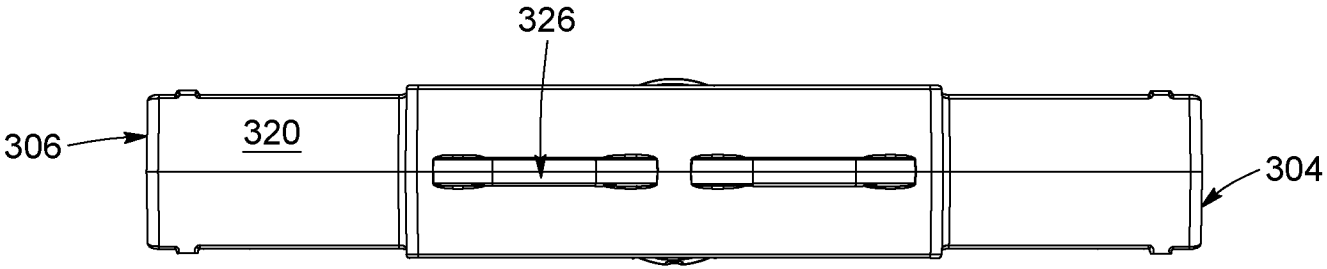

Referring now to FIGS. 7 and 8A-8B, yet another possible configuration of a structure 500 constructed from the concrete system 10 of the invention is shown. In this embodiment, the veneer units 200*i*, 200*ii*, 200*ii* are mounted in a vertical orientation relative to the structural blocks. The connectors are placed orthogonally relative to the channels of the structural blocks, and the ends/narrower portions of the connectors fit into the veneer channels of the veneer units, to retain said veneer units onto the structural blocks. The usual alignment between the veneer units and the structural blocks can therefore be broken. In the present case, the structure 500 is a double-sided wall, which has one side on which the veneer units are mounted orthogonally (or vertically) relative to the structural blocks, and one side on which the veneer units are mounted longitudinally (or horizontally). On the side where the veneer units are mounted horizontally, the ribs/male portions 112 of the structural blocks are inserted the veneer channels to connect the units to the blocks, and on the side where the veneer units are mounted vertically, the connectors are used. It will be noted that the channels at the back of the veneer units could be positioned at an angle (or obliquely) on the rear face of units, and the connectors could be configured to be blocked at the same predetermined angle, allowing installation of the veneers at a specific angle relative to the ground.

Figure 12:
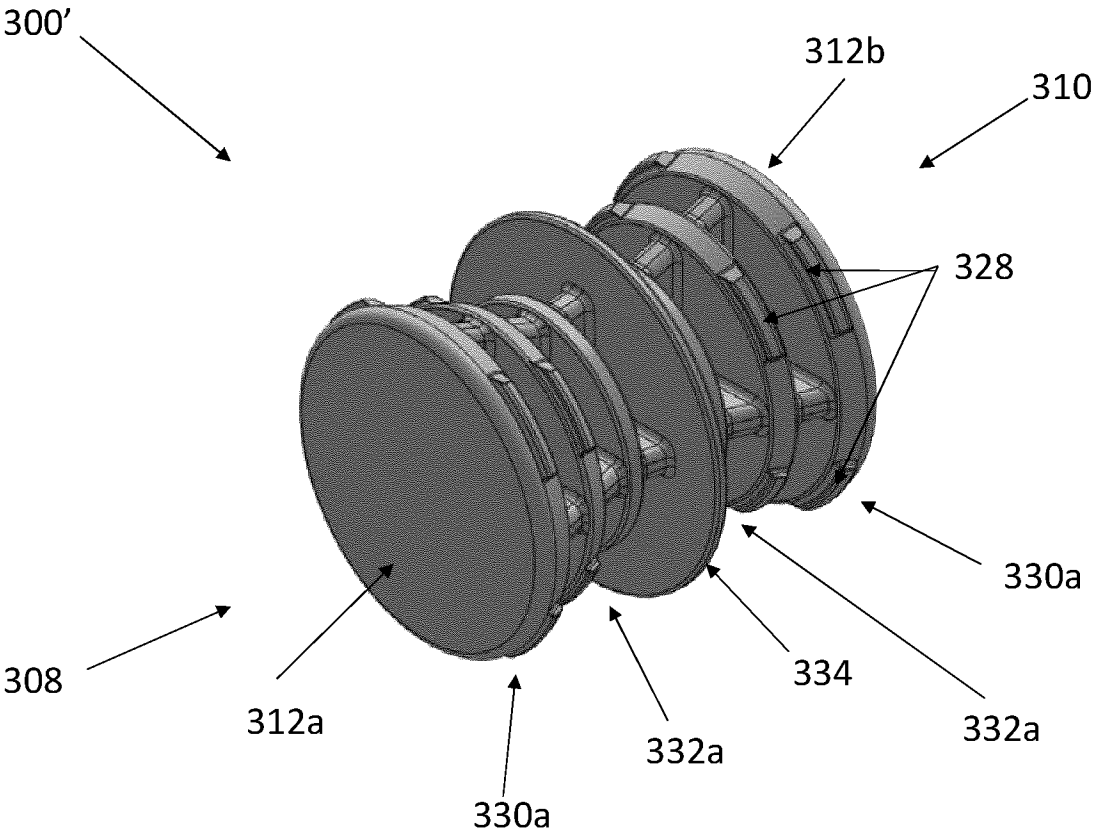
FIG. 12 is a perspective view of a connector according to another possible embodiment.

Referring to FIG. 12, another possible embodiment of a connector 300' is shown. The connector comprises first and second faces 308, 310, both faces being substantially similar. In this embodiment, each face comprises a knob 312*a* or 312*b*, which is shaped, sized and configured to be inserted in veneer unit channels and/or structural block channels. Similar to the embodiment illustrated in FIGS. 9A-11C, the knobs preferably have a frustroconical shape, with the base portions 332*a*, 332*b* being narrower than the corresponding head portions 330*a*, 330*b*, such that they can fit into a veneer and/or structural block channel. Just like in the first embodiment of the connector, other shapes are possible, as long as the knob shape is complementary to that of the veneer unit channels and/or structural block channels. The knobs 312*a*, 312*b* are similar to the knob of connector 300 in FIGS. 9A-11C, i.e. they include friction elements 328 to frictionally engage with sidewalls of the channels, and they are preferably made of a plastic such as polyethylene. In this embodiment, the connector 300' includes a base plate 334 to contact and engage with the rear wall of the veneer unit channels and/or structural block channels. The diameter of the base plate is preferably greater than the base portions, but does not exceed the diameter of the head portions of the knobs. In the illustrated embodiment, the base plate 334 is shaped as a disk, but other shapes are possible. For example, flanges could extend from the center of the connector and serve the same purpose. Using connectors with a double knob configuration allows for easy rotation of veneer units relative to structural blocks, enabling the constructions of walls and structures with irregular patterns and tessellations. The connector 300' allows installing veneer units on structural blocks in different orientations—such as ashlar patterns—as will be explained in reference to FIGS. 14 to 16B.

Figure 13:
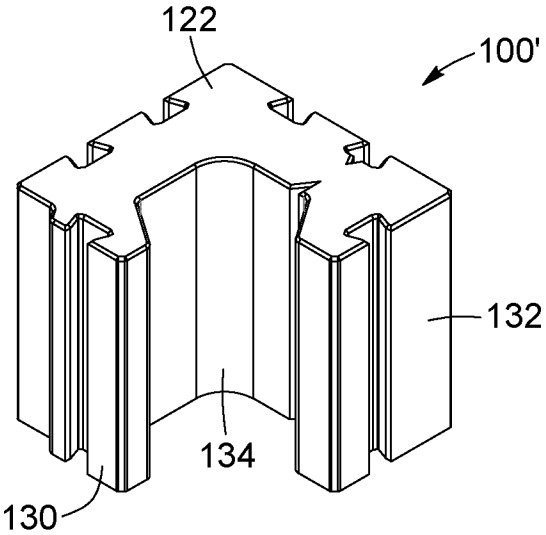
FIG. 13 is a top perspective view of a structural block, according to another possible embodiment.
Figure 13A:
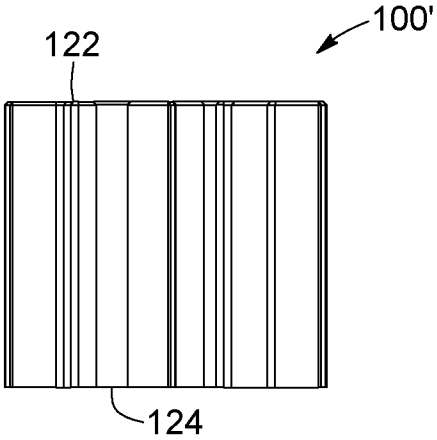
FIGS. 13A to 13F are respective top, bottom and side views of structural block of FIG. 13.
Figure 13B:
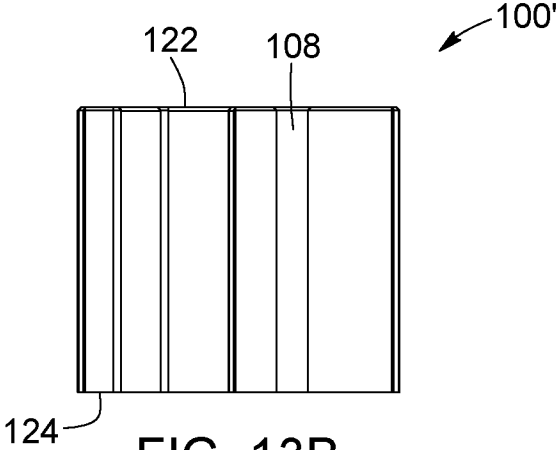
Figure 13C:
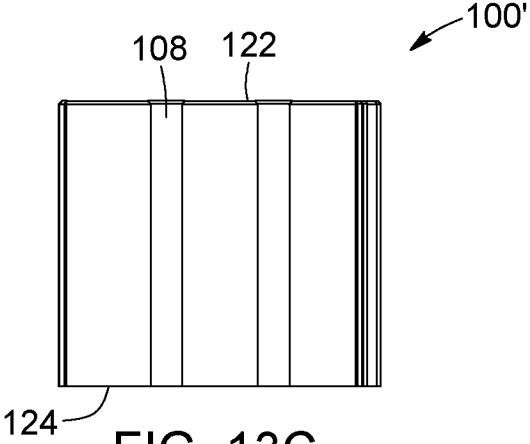
Figure 13D:
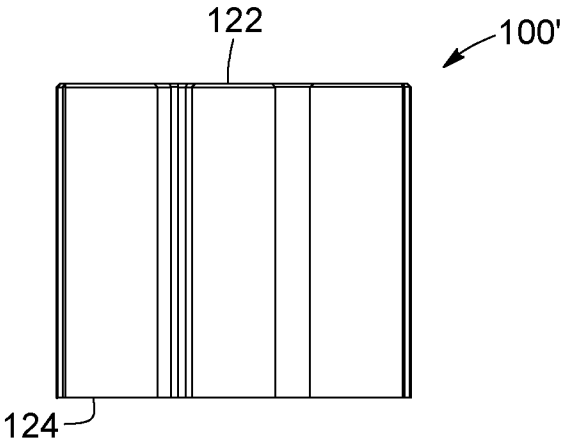
Figure 13E:
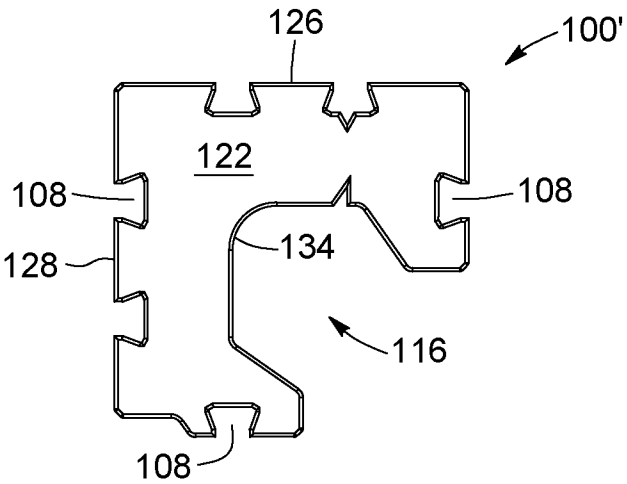
Figure 13F:
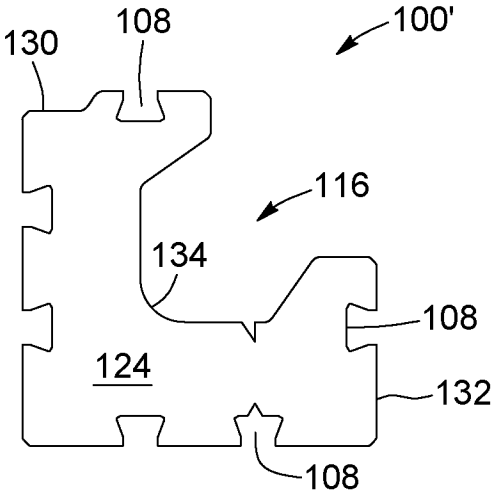
Figure 14:
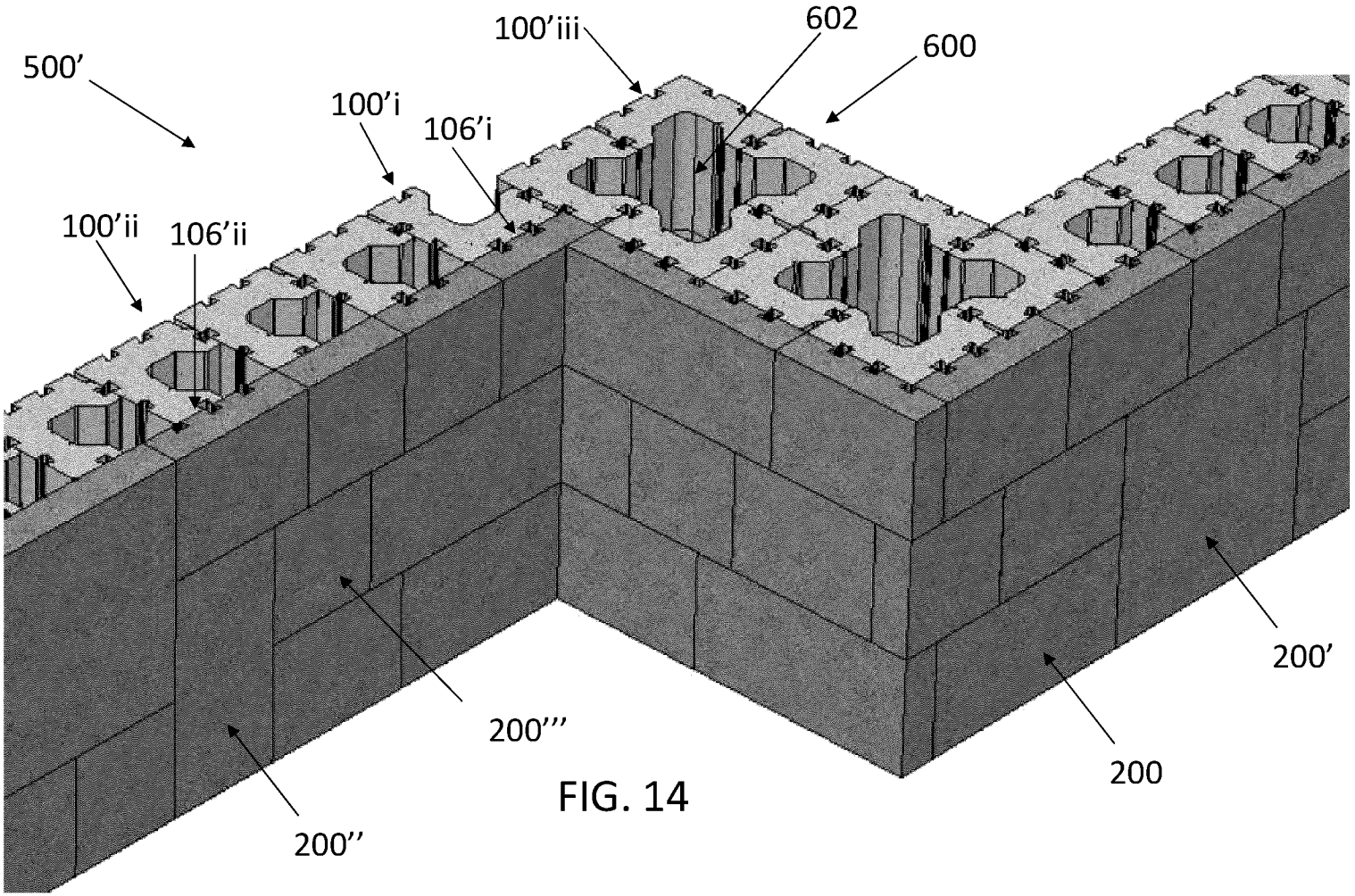
FIG. 14 is a top perspective view of a structure constructed with the concrete block system.

Referring now to FIG. 13, another possible embodiment of a structural block 100' is shown. The structural block 100' still includes a top side 102, a bottom side 104, and lateral sides 106*a*-106*d*, the top and bottom sides comprising load bearing surfaces, that will contact the soil or other stacked structural blocks. In this embodiment, the lateral sides only comprise one or more female connecting portions, shaped as channels 110, without any male connecting portions—such as the ribs 112 in structural block 100 illustrated in FIGS. 1A to 8B. While each of the lateral sides 106*a*-106*d* preferably includes at least one channel, it can be considered that only some of the lateral sides 106*a*-106*d* be provided with block channels. Although less practical, it can also be considered providing the channels horizontally on the structural blocks 100, when in use, rather than vertically. Except for replacing some of the ribs by channels, the remainder of the structural block 100' is similar to that of block 100, presented in FIGS. 1A-8B. Structural block 100' preferably has an L shape, forming a recess or cavity 116. Some of the channels 110 facing one another comprise notches 114*i*, 114*ii* to facilitate the breaking off of a portion of the structural block 100'.

Referring to FIGS. 14, 15 and 16A-16B, a portion of a structure 500', in this case a wall, built with the present system 10 is illustrated. The structure 500' is built with a plurality of structural blocks 100'; rectangular or square veneer units of different sizes; and connectors 300'. Although the structure illustrated comprises only connectors 300' such as shown in FIG. 12, it is possible to combine the different connectors 300 and 300' within the same structure, as well as different types of structural blocks 100, 100". As can be appreciated, the structural blocks 100 or 100' can be assembled to form columns 600, with a closed cavity 602 formed therein. The structural blocks that are not connected to any veneer units, such as block 100'*iii*, can be connected to adjacent structural blocks, with male/female connecting parts integrally formed in the blocks, or with connectors 300 or 300'. In addition, as can be appreciated, the structural blocks can be positioned in different orientations relative to the veneer units: structural block 100'*i* has one of its full or wider sides 106'*i* connected to a veneer unit, while structural block 100'*ii* has one of its shorter sides 106'*ii* connected to another veneer unit. The L shape of the structural blocks advantageously allows installing them in different positions.

Figures 16A, 16B:
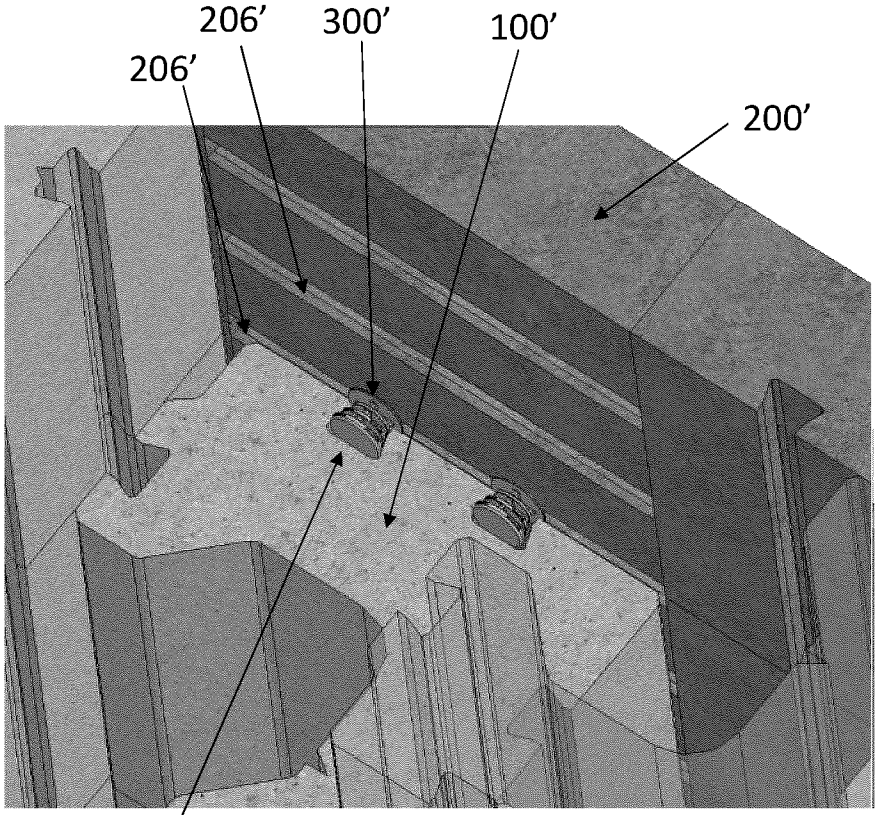

Yet another benefit of the present concrete block system, is the possibility of installing veneer units of different sizes and in different orientations on the structural blocks 100 or 100'. With the combined use of connectors 300', and structural blocks 100' with only female connecting portions or channels, the veneer units can be installed vertically, horizontally, or even at angle, relative the block channels 108, which allows for creating facades with a random and irregular design. As shown in FIGS. 15, 16A and 16B, in which some of the veneer units are shown in transparency, some of the veneer channels 206' are orthogonal relative to the block channels 108, while others are parallel relative to the block channels. The connectors 300' and structural blocks 100' thus allow connecting the veneer units to the structural blocks in different orientations. The block system can thus include squared-shape and/or rectangular veneer units of different sizes, and allows installing veneer units vertically, in a "jumper" or "sailor" configuration, as well as horizontally, in a "shiner" configuration. As mentioned previously, the channels of the structural blocks and/or of the veneer units can also run at an angle or obliquely. The shape of the veneer units can also be other than square or rectangular: hexagonal or other shapes are possible, so as to form tessellations when installed.

Figure 17B:
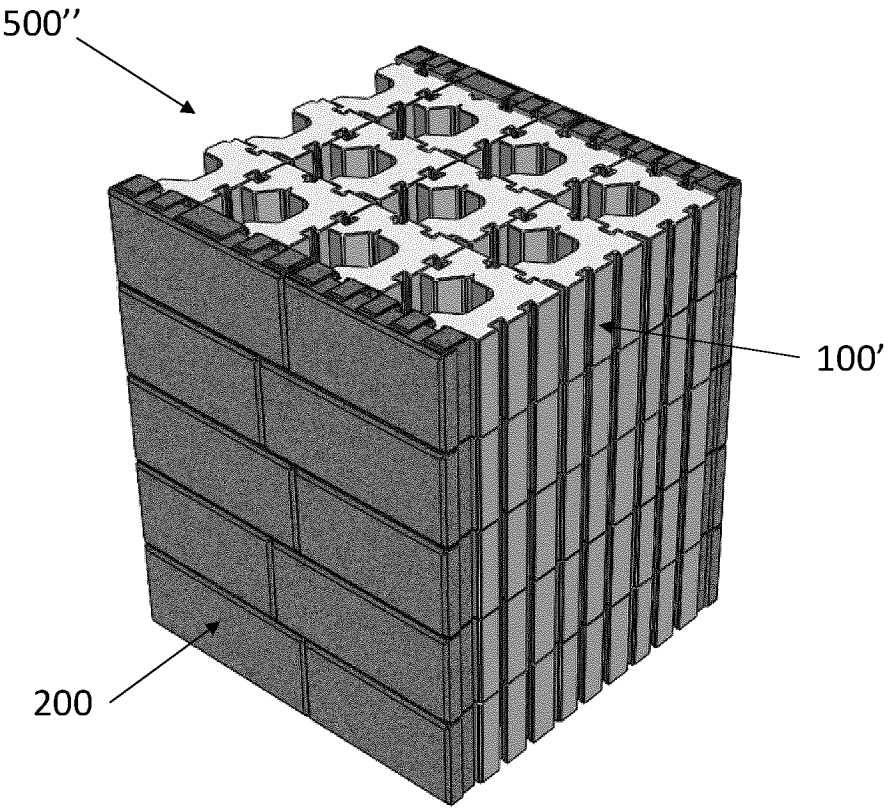
FIGS. 17A and 17B show different structures comprising components of the concrete system, assembled in different configurations.
Figure 17A:
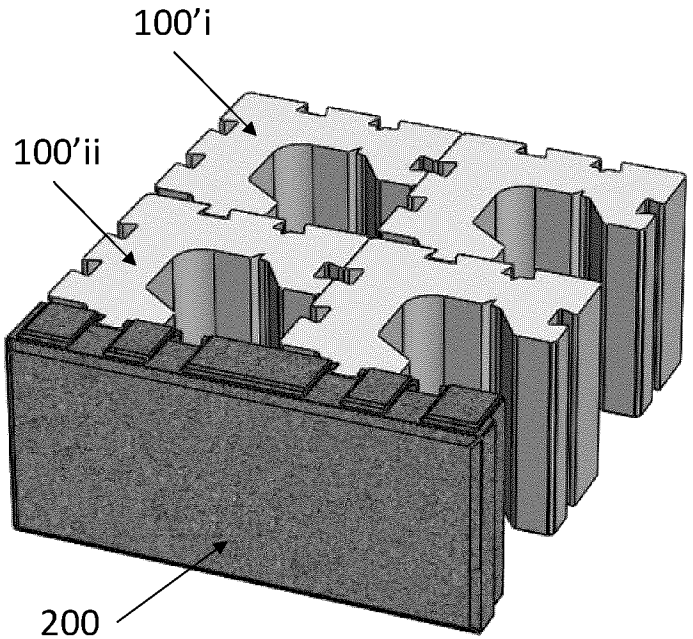

Referring to FIGS. 17A and 17B, the structural blocks can also be installed in a "piggy back" configuration, where they are assembled one behind the other. This configuration assembly allows extending the base of a structure, such as a retaining wall, with or without the use of connectors 300, 300'. In FIG. 17A, structural block 100'*ii* attaches to both the veneer unit 200, and structural block 100'*i*. In this case, female/male connecting portions are used, and more specifically ribs and channels, but structural blocks such as shown in FIG. 13 can be installed in the configuration as well, using connectors 300. As shown in FIG. 17B, more than two rows of structural blocks can be formed, with veneer units 200 installed on both sides of the wall 500".

Figure 18:
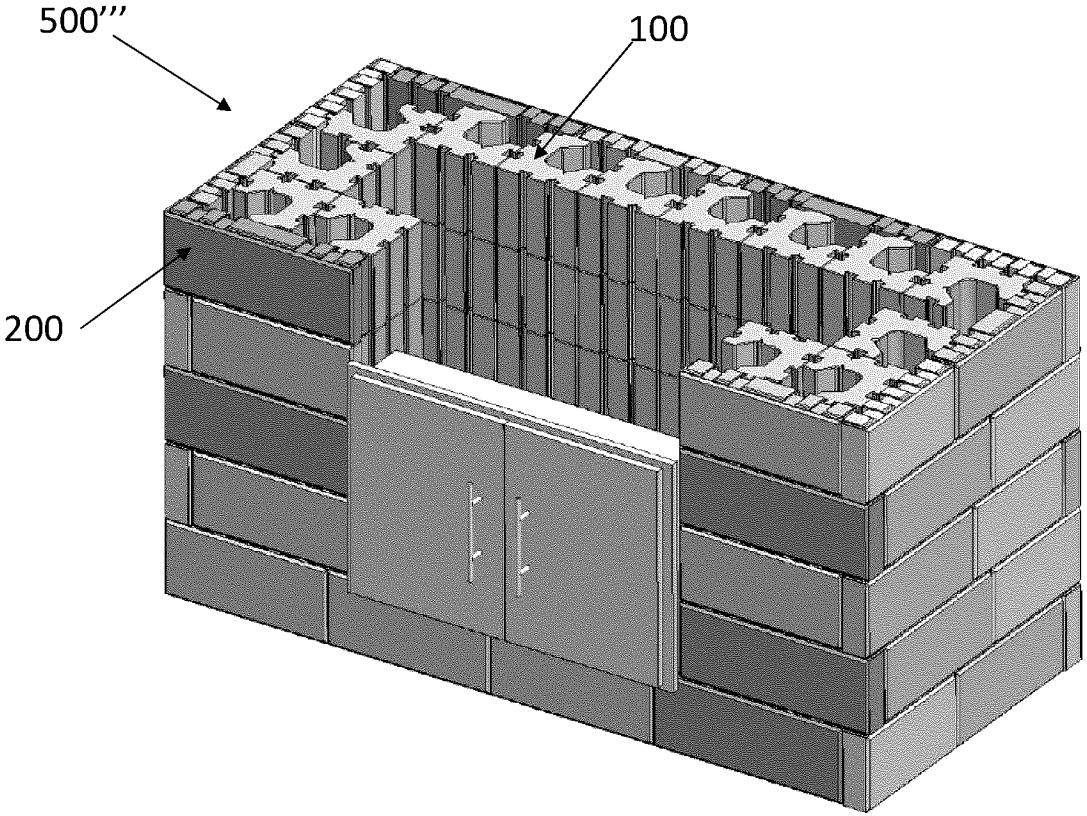
FIG. 18 is a perspective view of a structure constructed with components of the concrete block system, for receiving a barbecue.
Figure 19A:
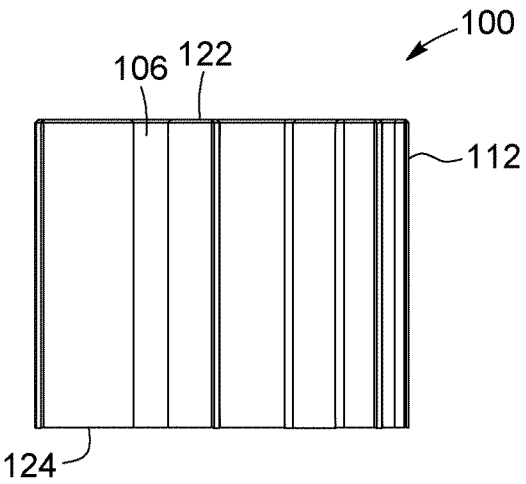
FIGS. 19A to 19F are respective top, bottom and side views of structural block of FIG. 19.
Figure 19:
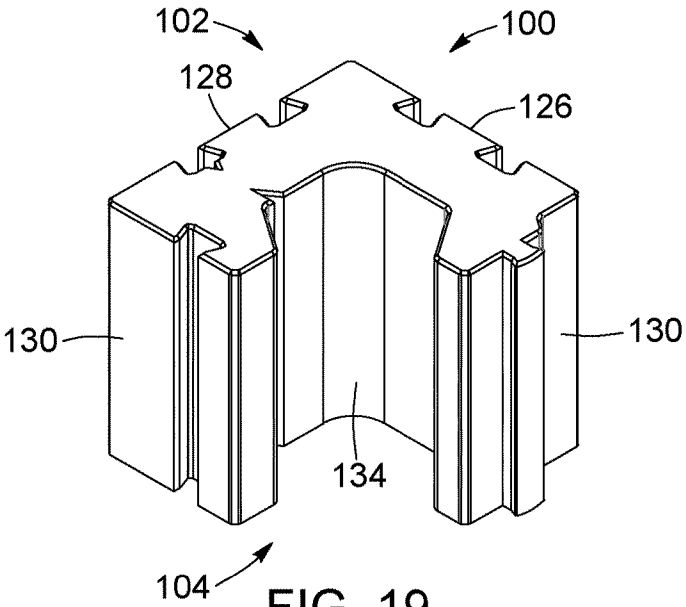
FIG. 19 is a top perspective view of a structural block, according to a possible embodiment.
Figure 19B:
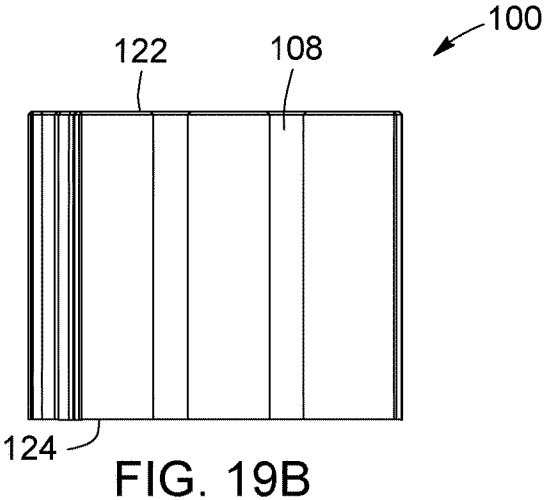
Figure 19C:
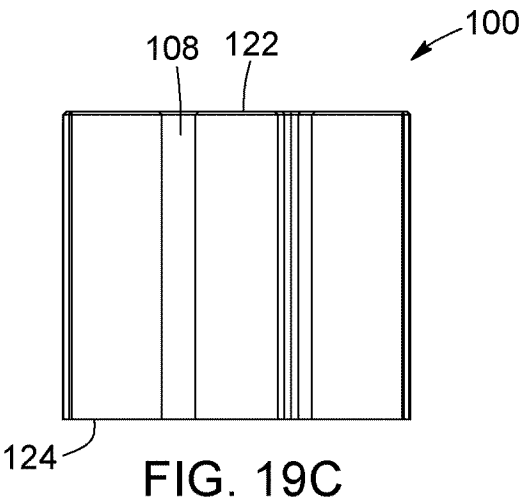
Figure 19D:
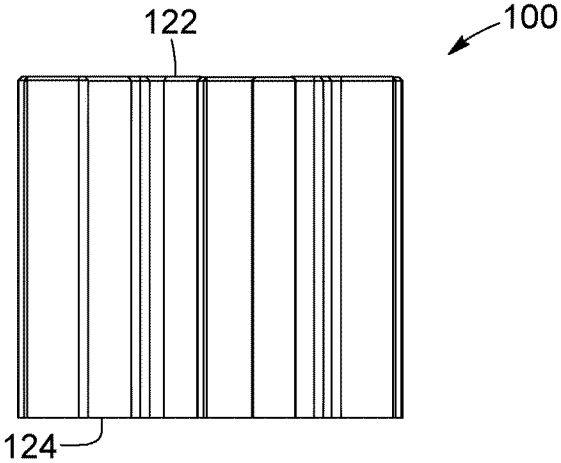
Figure 19E:
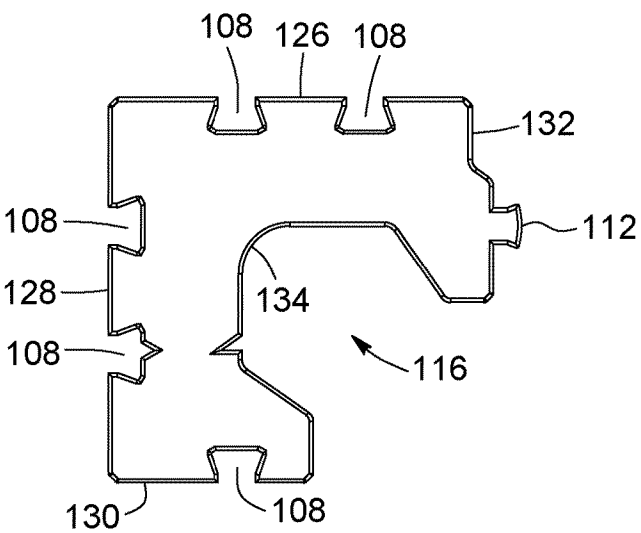
Figure 19F:
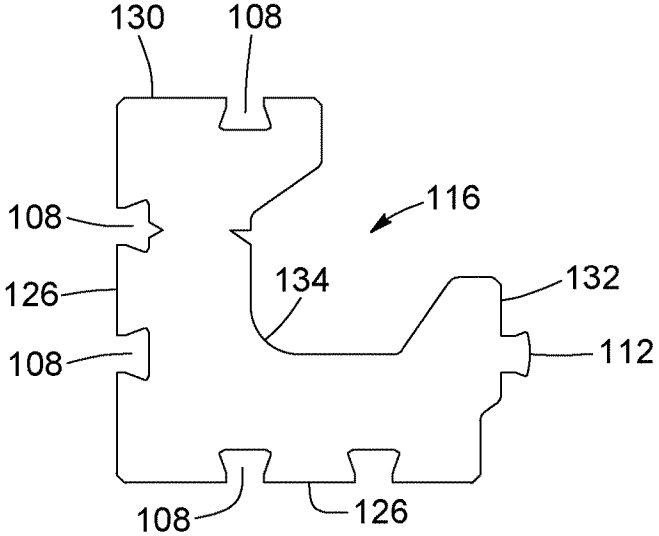
Figure 20A:
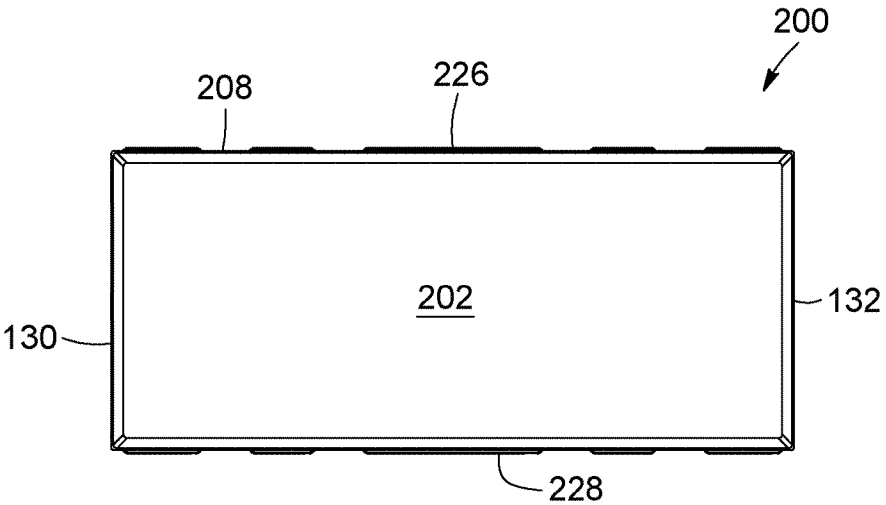
Figure 20B:
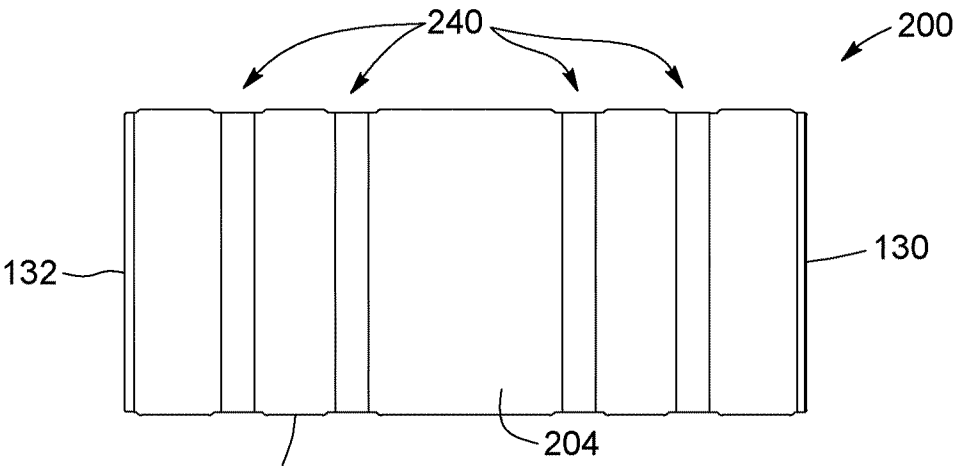
Figure 20:
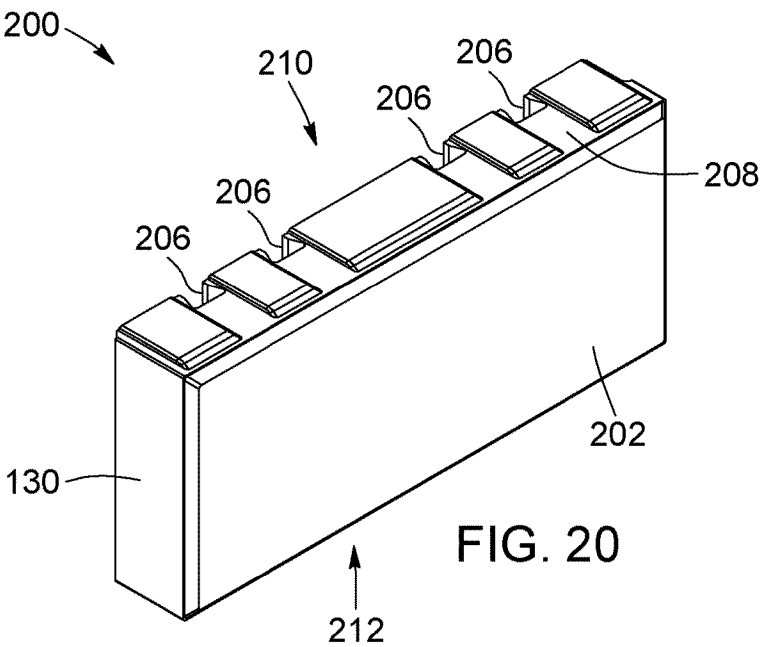
FIG. 20 is a top perspective view of a veneer unit, according to a possible embodiment.

Finally, referring to FIG. 18, yet another possible structure 500'" constructed with the block system, is shown. The structure can be an outdoor barbecue island, with structural blocks 100 defining an empty rectangular base structure for receiving the barbecue, and with veneer units 200 attached to the structural blocks.

As can be appreciated, the concrete block system described above allows for the use of a single type of connector to perform different functions in a vertical structure, which is typically realized using different components. According to one aspect of the present invention, a non-integral connector can be used to connect structural blocks together when they are not connected to any veneer unit; to connect veneer units to structural blocks, in different orientations; to create near vertical installations or setbacks between each stacked rows of structural blocks. In addition, the system may provide for a single structural block, which can be used for both straight portions or corners of a same structure. The structural blocks can also be used to create double-sided walls, with opposite lateral walls being configured to received/retain veneer units thereon and columns.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A mortarless concrete block system for constructing a structure, the system comprising:

a plurality of structural blocks made of concrete, each structural block having:

a top face and a bottom face, the top face and bottom face being substantially L-shaped, four lateral faces and a concave inner face extending between top and bottom faces, two of said lateral faces being wide lateral faces forming a corner in said block, and two of said lateral faces being short lateral faces, the concave inner face being located between the short lateral faces and forming a cavity or recess in the structural block;

at least two of said lateral faces being provided with connecting elements formed and shaped therein;

a plurality of veneer units, each unit having an exposed face and a rear face, two short lateral faces and two long lateral sides; the rear face being provided with connecting elements; and a plurality of connectors, each being sized, shaped and configured to attach the veneer units to the structural blocks or to attach two structural blocks together, via the respective block and veneer connecting elements, wherein any given connector from said plurality of connectors is suitable for connecting two structural blocks together, or for connecting a veneer unit to a structural block.

2. The mortarless concrete structure block system according to claim 1, wherein the connecting elements of the veneer units are connectable to the connecting units of the structural blocks.

3. The mortarless concrete structure block system according to claim 1, wherein the connecting elements of the structural blocks comprises one or more block channels extending from the top L-shaped face to the bottom L-shaped face.

4. The mortarless concrete structure block system according to claim 1, wherein the connecting elements of the structural blocks comprises a block rib extending from the top face to the bottom face.

5. The mortarless concrete structure block system according to claim 1, wherein the connecting elements of the veneer units comprises one or more veneer channel extending on the rear face.

* * * * *